US006516167B2

(12) United States Patent
Takamura

(10) Patent No.: US 6,516,167 B2
(45) Date of Patent: Feb. 4, 2003

(54) OPTION APPARATUSES ADAPTED TO BE CONNECTED TO REMOTE APPARATUS AND IMAGE FORMATION APPARATUS

(75) Inventor: Mitsuhide Takamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/808,177

(22) Filed: Mar. 15, 2001

(65) Prior Publication Data

US 2001/0026698 A1 Oct. 4, 2001

(30) Foreign Application Priority Data

Mar. 16, 2000 (JP) ..... 2000-074828

(51) Int. Cl.[7] ..... G03G 15/00
(52) U.S. Cl. ..... 399/75; 358/1.14; 399/88
(58) Field of Search ..... 399/1, 8, 9, 18, 399/37, 75, 88; 358/1.12, 1.13, 1.14, 1.15, 1.18, 401, 437; 400/74; 364/183; 371/2.1, 21.6, 47.1, 48; 382/309

(56) References Cited

U.S. PATENT DOCUMENTS 5,317,366 A * 5/1994 Koshi et al. ..... 399/1
5,420,667 A * 5/1995 Kaneko et al. ..... 399/8
6,028,675 A 2/2000 Fields et al. ..... 358/1.14
6,078,400 A * 6/2000 Mizutani ..... 358/1.14

* cited by examiner

*Primary Examiner*—Hoan Tran
(74) *Attorney, Agent, or Firm*—Fitzpatrick, Cella, Harper & Scinto

(57) ABSTRACT

An image formation apparatus has a controller which performs monitoring and control over a directly connected option apparatus by communicating with a controller of the directly connected option apparatus. Monitoring and control over another option apparatus that itself has a controller is performed not by the controller of the image formation apparatus but by the controller of the option apparatus close to the image formation apparatus. The image formation apparatus can keep track of the situation of a far-off option apparatus without performing direct monitoring or control thereof, by the controller of the option apparatus sending to the controller of the image formation apparatus a notice indicating the situation of the option apparatus sent from the controller of yet another option apparatus.

14 Claims, 25 Drawing Sheets

OPERATION OF IMAGE FORMATION APPARATUS 100
START
S100
CPU INITIALIZATION
S101
TURN ON POWER TO OPTION APPARATUS TIMER START
S102
TIMER TIME OUT?
NO
YES
S103
TURN ON POWER TO OPTION APPARATUS
S104
RECEIVE OPTION APPARATUS INFORMATION
S105
SET OPTION APPARATUS CONNECTION STATE
S106
RECEIVE OPTION APPARATUS INFORMATION
S107
SET OPTION APPARATUS CONNECTION STATE
END

OPERATION OF OPTION APPARATUS 101, 133

OPERATION OF OPTION APPARATUS 102, 134

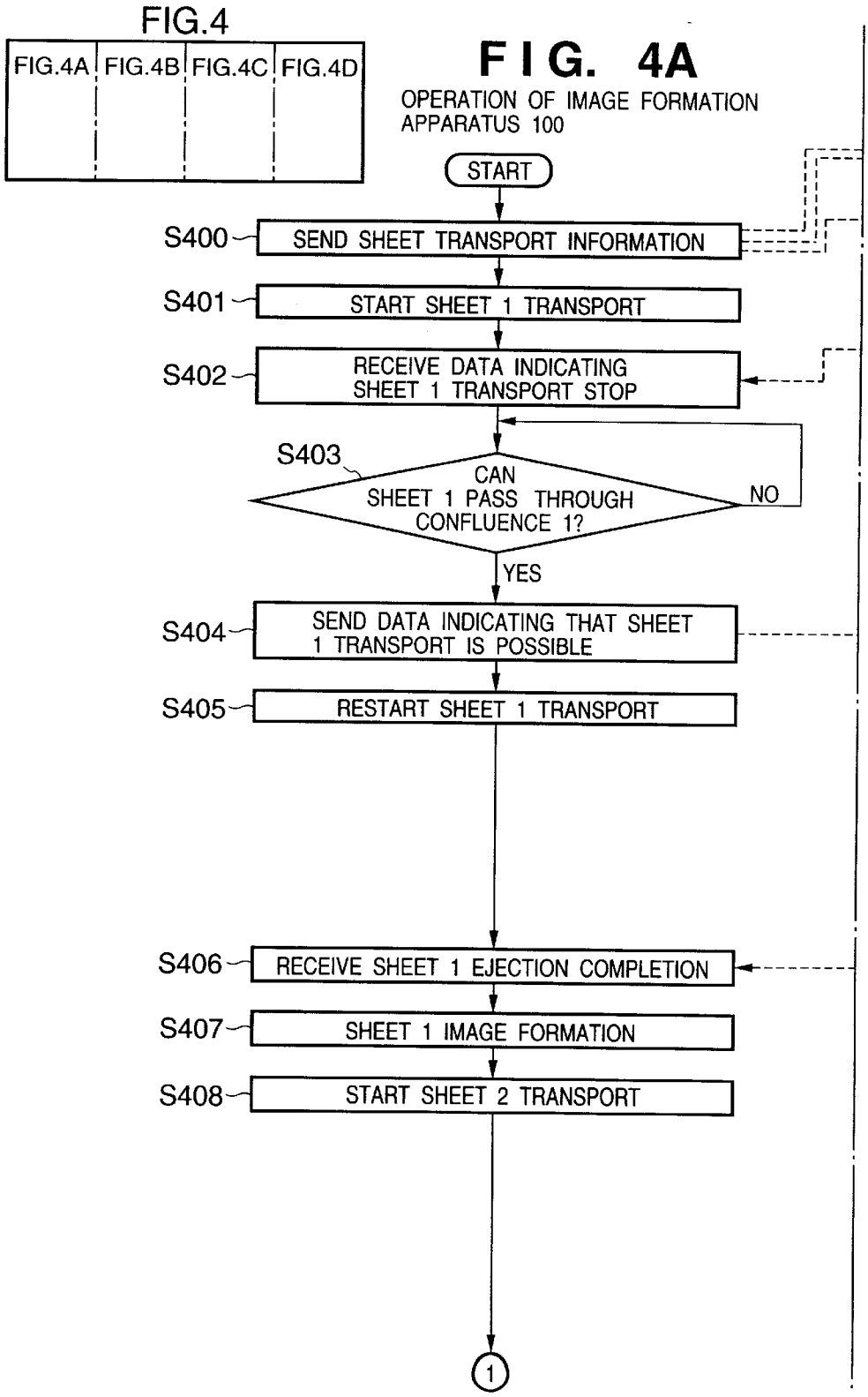
FIG.4
FIG.4A
FIG.4B
FIG.4C
FIG.4D
FIG. 4A
OPERATION OF IMAGE FORMATION APPARATUS 100
START
S400
SEND SHEET TRANSPORT INFORMATION
S401
START SHEET 1 TRANSPORT
S402
RECEIVE DATA INDICATING SHEET 1 TRANSPORT STOP
S403
CAN SHEET 1 PASS THROUGH CONFLUENCE 1?
NO
YES
S404
SEND DATA INDICATING THAT SHEET 1 TRANSPORT IS POSSIBLE
S405
RESTART SHEET 1 TRANSPORT
S406
RECEIVE SHEET 1 EJECTION COMPLETION
S407
SHEET 1 IMAGE FORMATION
S408
START SHEET 2 TRANSPORT
1

OPERATION OF OPTION APPARATUS 102

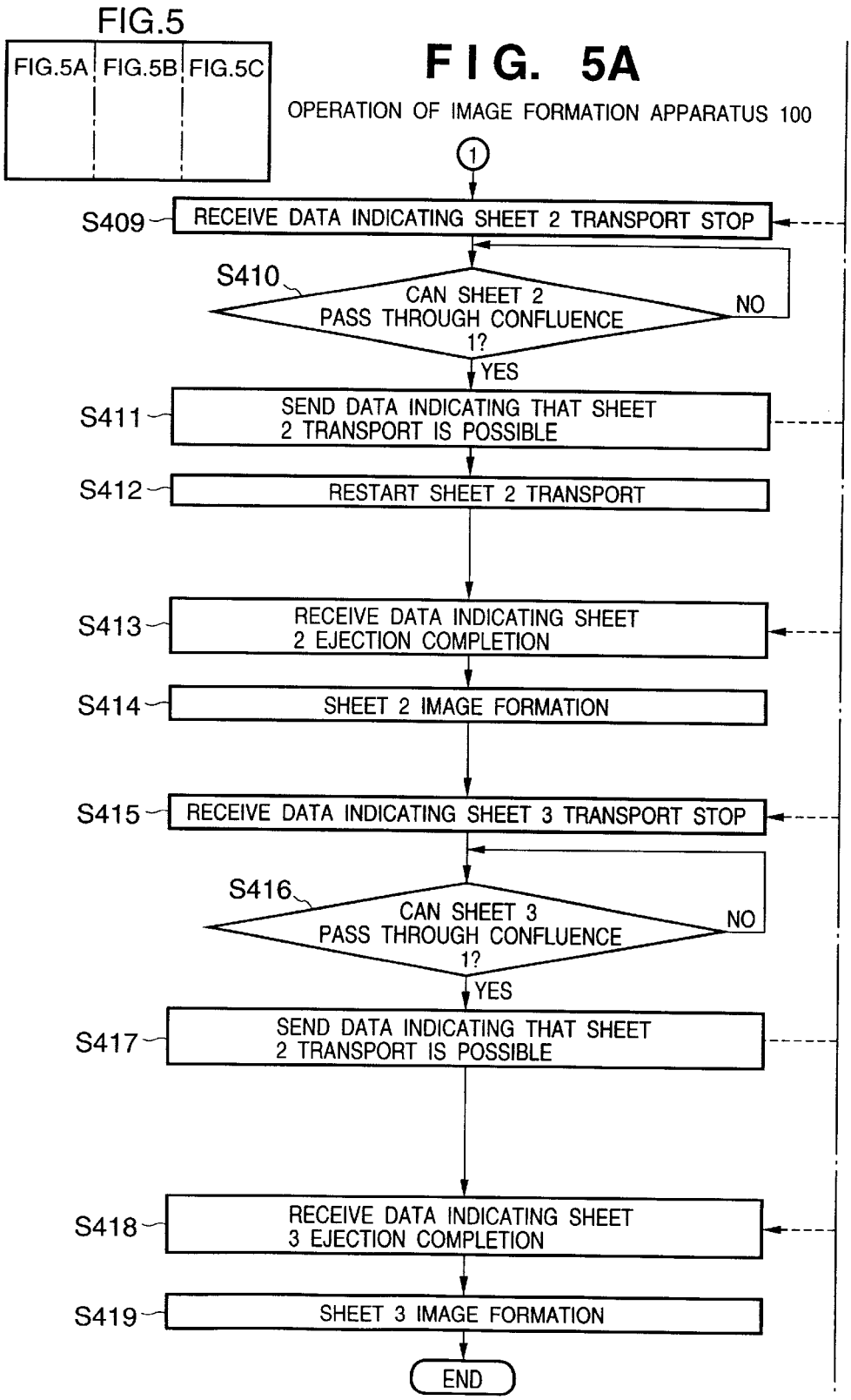
FIG.5
FIG.5A
FIG.5B
FIG.5C
FIG. 5A
OPERATION OF IMAGE FORMATION APPARATUS 100
1
S409
RECEIVE DATA INDICATING SHEET 2 TRANSPORT STOP
S410
CAN SHEET 2 PASS THROUGH CONFLUENCE 1?
NO
YES
S411
SEND DATA INDICATING THAT SHEET 2 TRANSPORT IS POSSIBLE
S412
RESTART SHEET 2 TRANSPORT
S413
RECEIVE DATA INDICATING SHEET 2 EJECTION COMPLETION
S414
SHEET 2 IMAGE FORMATION
S415
RECEIVE DATA INDICATING SHEET 3 TRANSPORT STOP
S416
CAN SHEET 3 PASS THROUGH CONFLUENCE 1?
NO
YES
S417
SEND DATA INDICATING THAT SHEET 2 TRANSPORT IS POSSIBLE
S418
RECEIVE DATA INDICATING SHEET 3 EJECTION COMPLETION
S419
SHEET 3 IMAGE FORMATION
END

OPERATION OF OPTION APPARATUS 101

OPERATION OF OPTION APPARATUS 102

OPERATION OF IMAGE FORMATION APPARATUS 100
START
S700
SEND SHEET TRANSPORT INFORMATION
S701
SEND INQUIRY WHETHER SHEET 1 CAN BE EJECTED
S702
COMMUNICATION MONITORING
S703
CAN SHEET 1 PASS THROUGH EJECTION PORT?
NO
YES
S704
SEND SHEET 1 EJECTION ADVANCE NOTICE
S705
START SHEET 1 EJECTION
S706
RESTART SHEET 1 TRANSPORT
S707
SEND INQUIRY WHETHER SHEET 2 CAN BE EJECTED
3

OPERATION OF OPTION APPARATUS 133

OPERATION OF OPTION APPARATUS 134

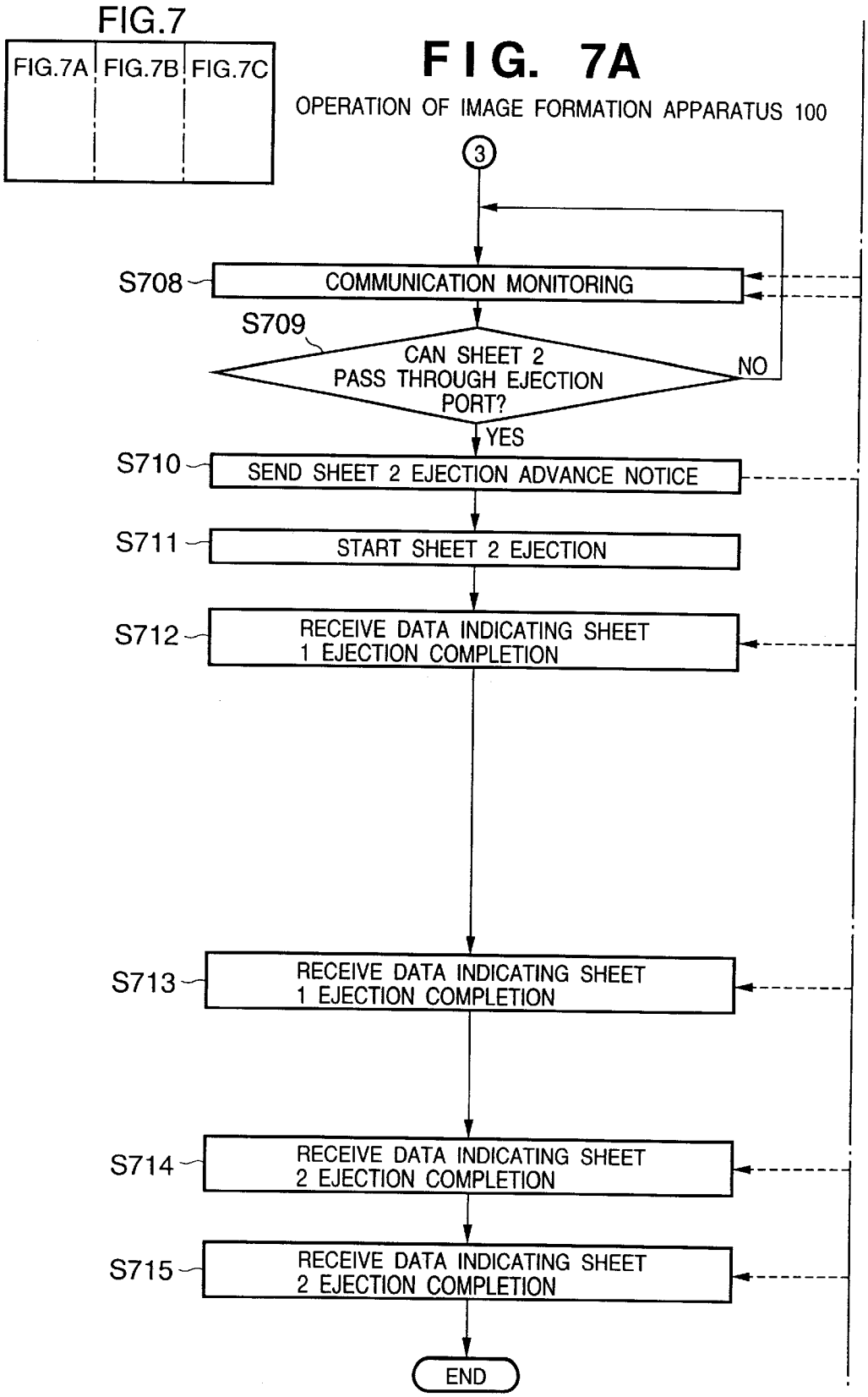
FIG.7
FIG.7A
FIG.7B
FIG.7C
FIG. 7A
OPERATION OF IMAGE FORMATION APPARATUS 100
3
S708
COMMUNICATION MONITORING
S709
CAN SHEET 2 PASS THROUGH EJECTION PORT?
NO
YES
S710
SEND SHEET 2 EJECTION ADVANCE NOTICE
S711
START SHEET 2 EJECTION
S712
RECEIVE DATA INDICATING SHEET 1 EJECTION COMPLETION
S713
RECEIVE DATA INDICATING SHEET 1 EJECTION COMPLETION
S714
RECEIVE DATA INDICATING SHEET 2 EJECTION COMPLETION
S715
RECEIVE DATA INDICATING SHEET 2 EJECTION COMPLETION
END

OPERATION OF OPTION APPARATUS 133

OPERATION OF OPTION APPARATUS 134

OPERATION OF IMAGE FORMATION APPARATUS 100
START
S716
SEND SHEET TRANSPORT INFORMATION
S717
RECEIVE SHEET 1, 2 TRANSPORT WAIT TIME
S718
RECEIVE SHEET 1, 2 TRANSPORT WAIT TIME
S719
CAN SHEET 1 PASS THROUGH EJECTION PORT?
NO
YES
S720
START SHEET 1 EJECTION
S721
RECEIVE DATA INDICATING SHEET 1 EJECTION COMPLETION
S722
CAN SHEET 2 PASS THROUGH EJECTION PORT?
NO
YES
S723
START SHEET 2 EJECTION
6

OPERATION OF OPTION APPARATUS 133

OPERATION OF OPTION APPARATUS 134

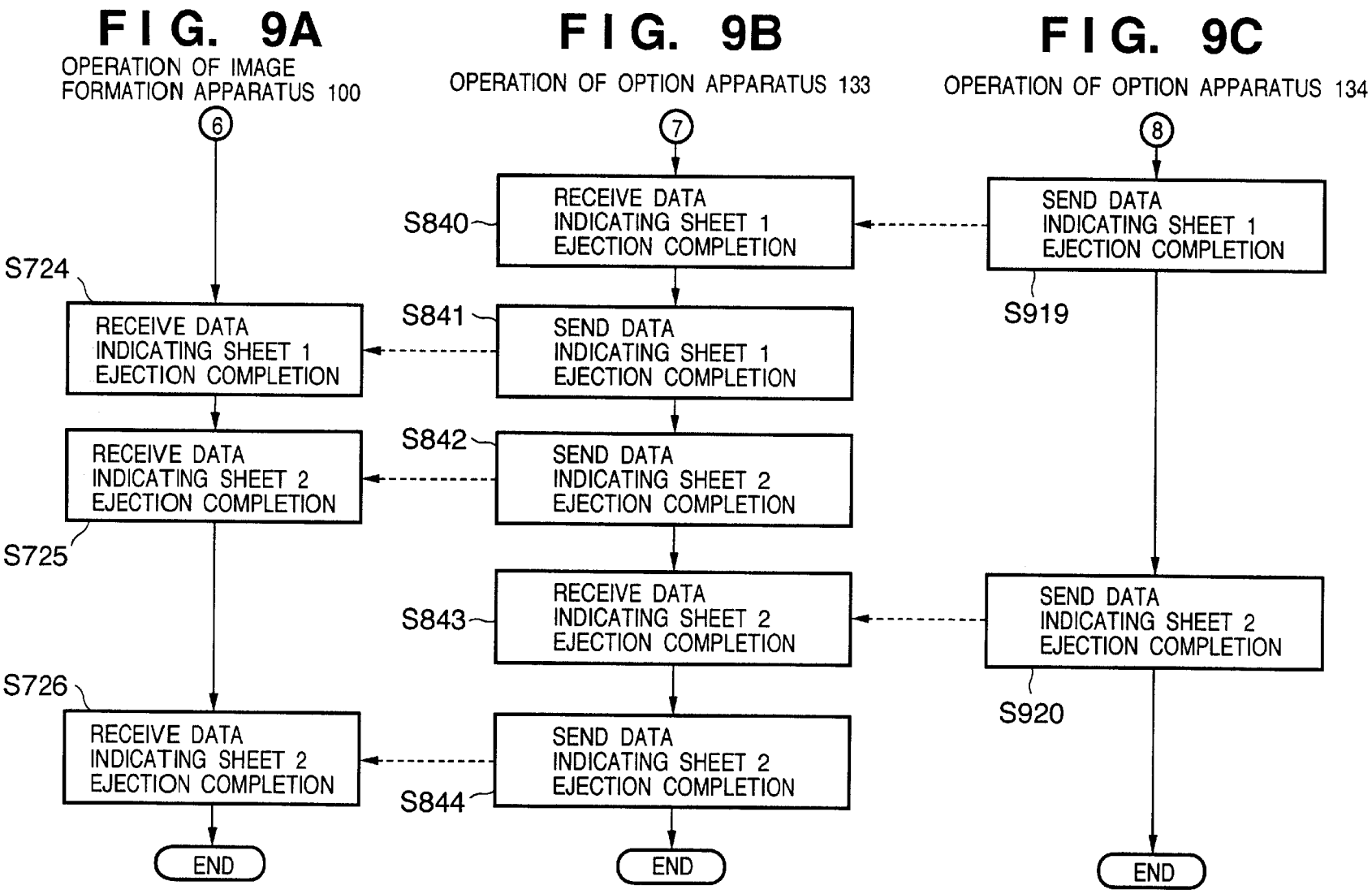
FIG. 9A
OPERATION OF IMAGE FORMATION APPARATUS 100
6
RECEIVE DATA INDICATING SHEET 1 EJECTION COMPLETION
S724
RECEIVE DATA INDICATING SHEET 2 EJECTION COMPLETION
S725
RECEIVE DATA INDICATING SHEET 2 EJECTION COMPLETION
S726
END
FIG. 9B
OPERATION OF OPTION APPARATUS 133
7
RECEIVE DATA INDICATING SHEET 1 EJECTION COMPLETION
S840
SEND DATA INDICATING SHEET 1 EJECTION COMPLETION
S841
SEND DATA INDICATING SHEET 2 EJECTION COMPLETION
S842
RECEIVE DATA INDICATING SHEET 2 EJECTION COMPLETION
S843
SEND DATA INDICATING SHEET 2 EJECTION COMPLETION
S844
END
FIG. 9C
OPERATION OF OPTION APPARATUS 134
8
SEND DATA INDICATING SHEET 1 EJECTION COMPLETION
S919
SEND DATA INDICATING SHEET 2 EJECTION COMPLETION
S920
END

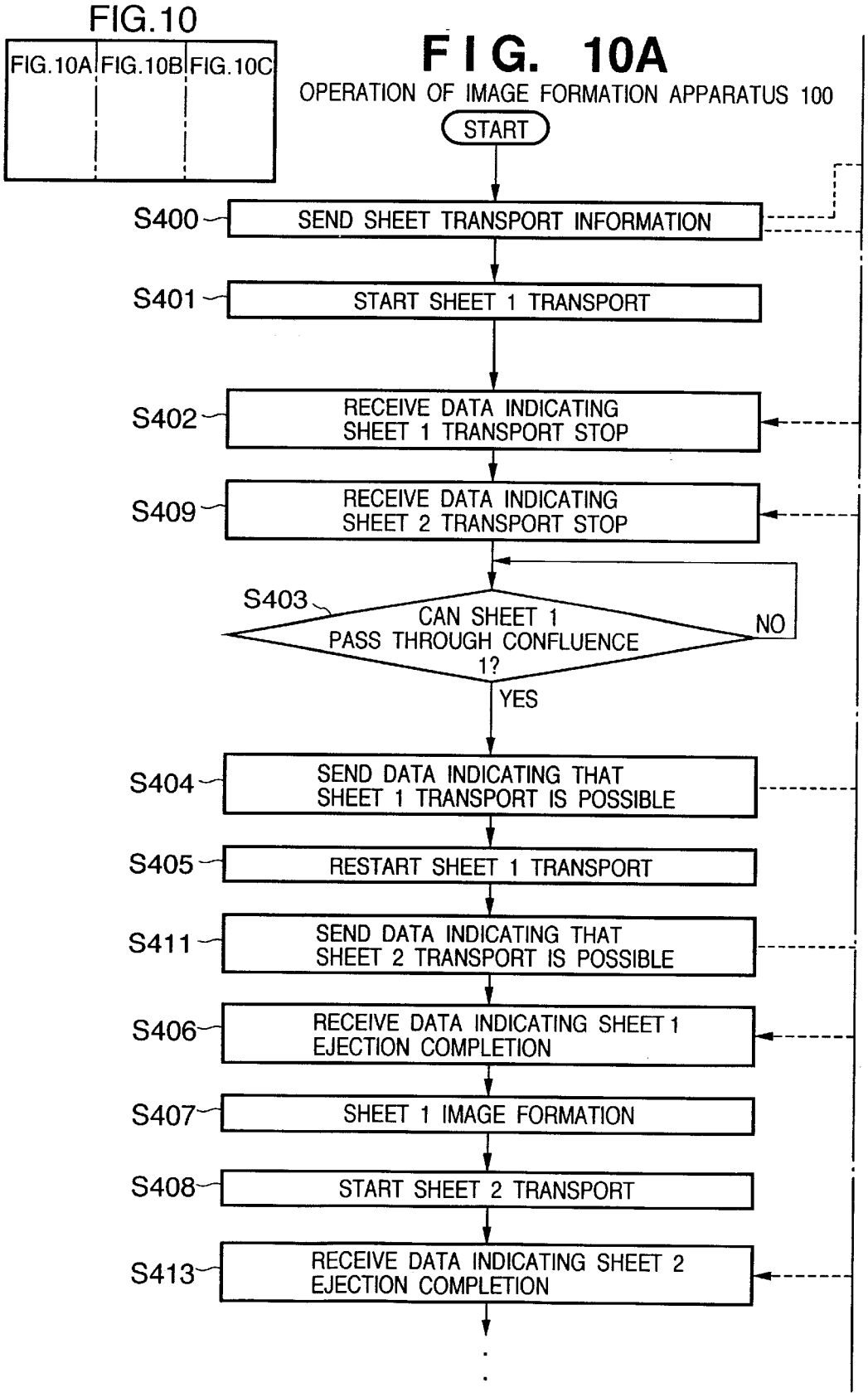
FIG.10
FIG.10A
FIG.10B
FIG.10C
FIG. 10A
OPERATION OF IMAGE FORMATION APPARATUS 100
START
S400
SEND SHEET TRANSPORT INFORMATION
S401
START SHEET 1 TRANSPORT
S402
RECEIVE DATA INDICATING SHEET 1 TRANSPORT STOP
S409
RECEIVE DATA INDICATING SHEET 2 TRANSPORT STOP
S403
CAN SHEET 1 PASS THROUGH CONFLUENCE 1?
NO
YES
S404
SEND DATA INDICATING THAT SHEET 1 TRANSPORT IS POSSIBLE
S405
RESTART SHEET 1 TRANSPORT
S411
SEND DATA INDICATING THAT SHEET 2 TRANSPORT IS POSSIBLE
S406
RECEIVE DATA INDICATING SHEET 1 EJECTION COMPLETION
S407
SHEET 1 IMAGE FORMATION
S408
START SHEET 2 TRANSPORT
S413
RECEIVE DATA INDICATING SHEET 2 EJECTION COMPLETION

OPERATION OF OPTION APPARATUS 102

OPTION APPARATUSES ADAPTED TO BE CONNECTED TO REMOTE APPARATUS AND IMAGE FORMATION APPARATUS

FIELD OF THE INVENTION

The present invention relates to an image formation apparatus connectable with a plurality of option apparatuses and the option apparatuses.

BACKGROUND OF THE INVENTION

A variety of option apparatuses connectable to an image formation apparatus are conventionally provided to expand the function of the image formation apparatus according to the user's desire and operating environment. Such option apparatuses include a paper feed option apparatus to allow volume feeding of paper, sorter, duplex printing unit, etc. each having a structure allowing communication with the image formation apparatus.

For example, when a plurality of paper feed option apparatuses is placed and connected downstream from the image formation apparatus, the image formation apparatus and the plurality of paper feed option apparatuses transport recording media (hereinafter referred to as "sheets") such as paper from a desired paper feed option apparatus to another image formation apparatus located downstream on the transport path while communicating with each other.

Conventionally, when an image formation apparatus is connected to a paper feed option apparatus that supplies recording media to perform media transport control, a controller in the image formation apparatus monitors transport control of sheets in all the paper feed option apparatuses and sends control data to the option apparatuses if necessary, thus carrying out all sheet transport control and monitoring processing. And also for a paper ejection option apparatus that performs a post-processing on sheets ejected from the image formation apparatus, a controller in the image formation apparatus performs the sheet transport control and monitoring processings for all the paper ejection option apparatuses.

Furthermore, as another example, it is provided that the sheet transport control and monitoring processings of the paper feed and paper ejection option apparatuses are separated from the controller in the image formation apparatus, and an option controller performs the sheet transport control and monitoring processings of all the option apparatuses.

However, such a conventional image formation apparatus has such problems as shown below:

If the number of paper feed option apparatuses is one or the sheet transport speed is not high, when the controller in the image formation apparatus or the option controller performs sheet transport control and monitoring processing of the paper feed option apparatus, an increase in the processing load of the controller would not be significant. However, when a plurality of option apparatuses is connected or the sheet transport speed is high, processing of the controller becomes more complicated, higher processing is required, the load of control and monitoring processing increases, which will require a high-speed and expensive processing unit such as a CPU to be used as the controller.

SUMMARY OF THE INVENTION

Therefore, it is an object of the present invention to provide an image formation apparatus, option apparatuses of the image formation apparatus and an image formation system made up of these image formation apparatus and option apparatuses capable of suppressing the increase of processing load on the controller of the image formation apparatus or the option controller when a plurality of option apparatuses is connected.

That is, a subject of the present invention is to provide an option apparatus for an image formation apparatus connectable directly or via another option apparatus to the image formation apparatus, capable of connecting a further option apparatus while being connected to the image formation apparatus, comprising directly connected communication means for communicating with the image formation apparatus or other option apparatuses and option apparatus controlling means for controlling the own operation based on an instruction received from an image formation apparatus directly connected on the image formation apparatus side or other option apparatuses via the communication means, characterized in that the option apparatus controlling means controls and/or monitors the operation of the other option apparatus directly connected away from the image formation apparatus and sends the state of the other option apparatuses to be controlled and/or monitored to the image formation apparatus directly connected on the image formation apparatus side or a further option apparatus using the communication means.

It is another subject of the present invention to provide an image formation apparatus that allows connection of a single and/or multiple option apparatuses of the image formation apparatus of the present invention, comprising image formation controlling means for controlling image formation processing using an option apparatus, characterized in that the image formation controlling means monitors and/or controls the operation of the option apparatus directly connected and monitors the states of the option apparatuses connected after the directly connected option apparatus through a communication with the directly connected option apparatus.

Furthermore, it is another subject of the present invention to provide an image formation system comprising an image formation apparatus and an option apparatus connectable directly or via another option apparatus to the image formation apparatus, capable of connecting a further option apparatus while being connected to the image formation apparatus, characterized in that the option apparatus comprises directly connected communication means for communicating with the image formation apparatus or another option apparatus and option apparatus controlling means for controlling the own operation based on an instruction received from an image formation apparatus directly connected on the image formation apparatus side or another option apparatus via the communication means, controls and/or monitors the operation of the other option apparatus directly connected away from the image formation apparatus and sends the state of the other option apparatus to be controlled and/or monitored to an image formation apparatus directly connected on the image formation apparatus side or a further option apparatus using the communication means, and the image formation apparatus comprises image formation controlling means for controlling image formation processing using an option apparatus and monitoring and/or controlling the operation of the option apparatus directly connected through a communication with the option apparatus controlling means of the option apparatus, characterized in that the image formation controlling means monitors the states of the option apparatuses connected after the directly connected option apparatus through a communication with the option apparatus controlling means owned by the directly connected option apparatus.

Furthermore, it is another subject of the present invention to provide a recording medium that stores a program that can be executed by a computer apparatus, characterized in that the apparatus that executes the program is allowed to function as an option apparatus of the image formation apparatus of the present invention.

Furthermore, it is another subject of the present invention to provide a recording medium that stores a program that can be executed by a computer apparatus, characterized in that the apparatus that executes the program is allowed to function as the image formation apparatus of the present invention.

Furthermore, it is another subject of the present invention to provide a recording medium that stores a program that can be executed by a computer apparatus, characterized in that the apparatus that executes the program is allowed to function as the image formation apparatus or option apparatus in the image formation system of the present invention.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 4A to 4D are flow charts showing a sheet transport processing procedure of an image formation apparatus and option apparatuses according to a first embodiment of the present invention;

FIGS. 5A to 5C are flow charts showing a sheet transport processing procedure of the image formation apparatus and option apparatuses according to the first embodiment of the present invention;

FIGS. 7A to 7C are flow charts showing sheet transport processing procedure of the image formation apparatus and option apparatuses according to the first embodiment of the present invention;

FIGS. 9A to 9C are flow charts showing sheet transport processing procedure of the image formation apparatus and option apparatuses according to the second embodiment of the present invention; and FIGS. 10A to 10C is a flow chart showing a sheet transport processing procedure of an image formation apparatus and option apparatuses according to a third embodiment of the present invention.

DETAILED DESCRIPTION OF THE PREFERRED EMBODIMENTS

Preferred embodiments of the present invention will now be described in detail in accordance with the accompanying drawings.

First Embodiment (Configuration of Image Formation Apparatus)

Figure 1:
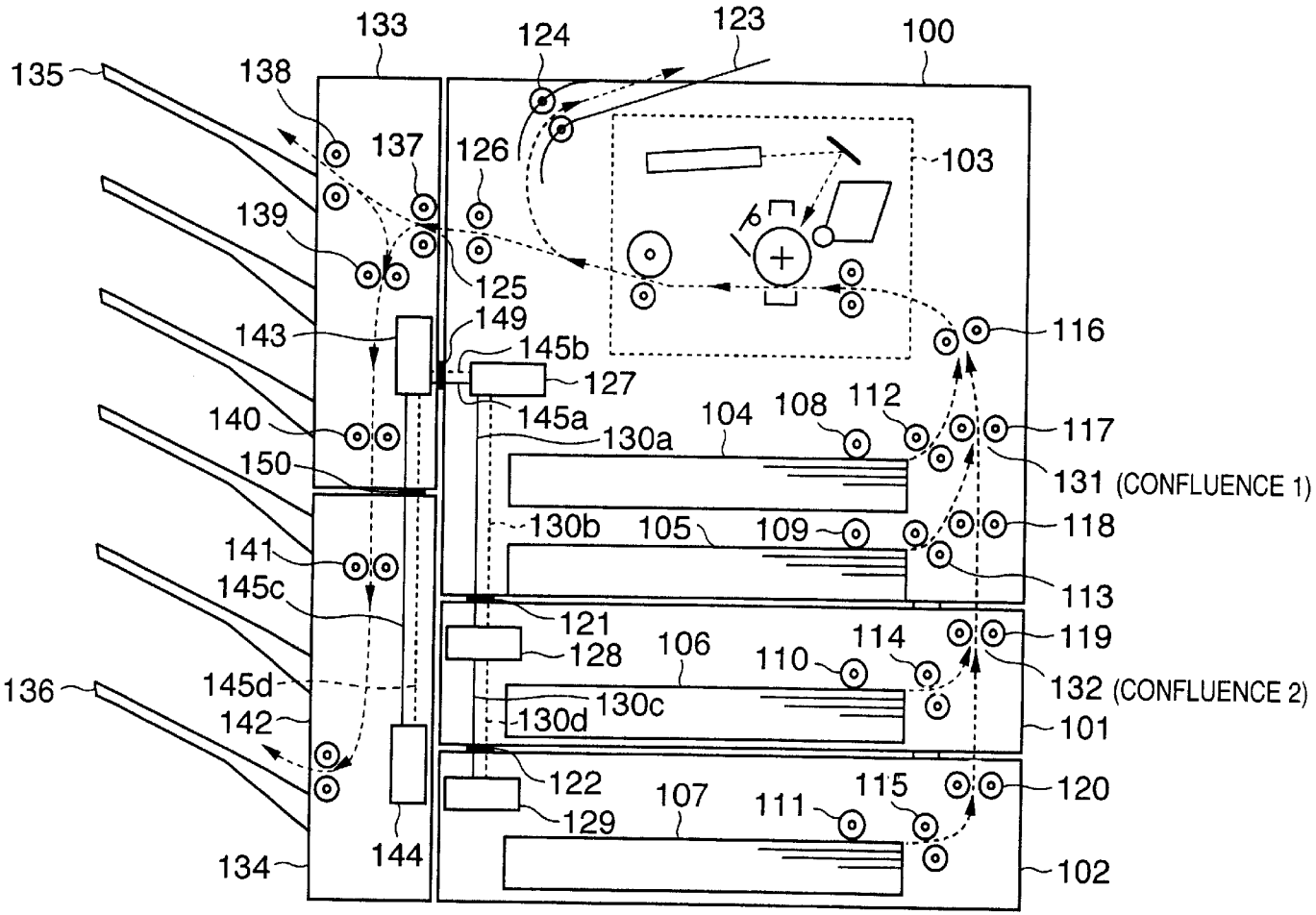
FIG. 1 illustrates a configuration of an image formation apparatus and option apparatuses according to an embodiment of the present invention.

FIG. 1 illustrates a configuration example of an image formation system made up of an image formation apparatus and option apparatuses according to an embodiment of the present invention. In this embodiment, the image formation apparatus forms toner images on a sheet through electrophotographic process.

In the figure, reference numeral 100 denotes an image formation apparatus, reference numerals 101 and 102 denote paper feed option apparatuses and reference numerals 133 and 134 denote paper ejection option apparatuses. The image formation apparatus 100 is placed above the option apparatus 101 and the option apparatus 101 is placed above the option apparatus 102.

Reference numerals 104 to 107 denote sheets to which images are transferred by the image formation apparatus and a plurality of sheets is loaded. Sheets 104 and 105 are placed in a paper feed apparatus built in the image formation apparatus. Reference numerals 108 to 111 denote pickup rollers that send sheets and groups of rollers 112 to 120 transport sheets to an electrophotographic process section 103.

A roller pair 117 is placed downstream on the transport path from the position where a sheet transported in the image formation apparatus 100 joins a sheet transported from the option apparatus 101. When the image formation apparatus 100 is already transporting a sheet, a sheet from the option apparatus 101 is temporarily stopped at the position just before the roller pair 117.

A roller pair 119 is placed downstream from the position where a sheet transported in the option apparatus 101 joins a sheet transported by the option apparatus 102. When the option apparatus 101 is already transporting a sheet, a sheet from the option apparatus 102 is temporarily stopped at the position just before the roller pair 119.

Reference numeral 121 denotes a connector that connects the image formation apparatus 100 and option apparatus 101 enabling communication with each other and relays a communication line 130*a* used to communicate a controller 127 in the image formation apparatus 100, a controller 128 in the option apparatus 101 and a controller 129 in the option apparatus 102, and a power supply control signal line 130*b*. As in the case of reference numeral 121, reference numeral 122 denotes a connector that connects the option apparatus 101 and the option apparatus 102 and relays the communication line 130*c* and the power supply control signal line 130*d*.

Reference numeral 123 denotes a tray to hold sheets with images formed by the electrophotographic process section 103 in the image formation apparatus and sheets are transported by a roller pair 124 with the side on which images are formed face down.

Reference numeral 125 denotes an ejection port for sheets with images formed by the electrophotographic process section 103 in the image formation apparatus and sheets are transported by a roller pair 126 with the side on which images are formed face up.

The plurality of sheets 104 to 107 is transported by the roller groups along the transport path indicated by dotted lines and arrows in FIG. 1 and ejected onto the tray 123 or through the ejection port 125 with images formed on their surfaces.

Reference numeral 131 denotes a confluence (1) of sheet transport paths in the image formation apparatus 100 and is located just before (upstream) the roller pair 117. The confluence (1) 131 indicates the position at which a sheet 105 transported in the image formation apparatus 100 joins a sheet 106 transported from the option apparatus 101.

Reference numeral 132 denotes a confluence (2) of sheet transport paths in the option apparatus 101 and is located just before the roller pair 119. The confluence (2) 132 indicates the position at which a sheet 106 transported in the option apparatus 101 joins a sheet 107 transported from the option apparatus 102.

Reference numeral 133 denotes an option apparatus connected downstream from the image formation apparatus 100 and ejects a sheet ejected from the image formation apparatus onto a tray provided for the option apparatus 133 or to an option apparatus 134 downstream.

Reference numeral 134 denotes an option apparatus installed below the option apparatus 133 and transports and ejects sheets transported from the option apparatus 133.

Reference numerals 135 and 136 denote trays to hold sheets transported by the option apparatuses 133 and 134 and reference numerals 137 to 142 denote roller pairs to transport sheets ejected from the image formation apparatus 100. For simplicity of explanations, FIG. 1 shows only roller pairs 138 and 142 to transport sheets out to the trays 135 and 136, but roller pairs to transport sheets out to other trays are also provided in the actual system.

Reference numerals 143 and 144 denote controllers of the option apparatuses 133 and 134 and are connected via a signal line 145*c* and power supply control line 145*d*. A signal line 145*a* and power supply control line 145*b* connect the controller 127 in the image formation apparatus 100 and the controller 143. Reference numerals 149 and 150 denote connectors between the image formation apparatus 100 and the option apparatus 133 and between the option apparatuses 133 and 134, respectively and relay the signal lines 145*a* and 145*c* and power supply control signal lines 145*b* and 145*d*.

However, the connectors 121, 122, 149 and 150 can also be replaced by cables or other communication means connectable in the order of transport paths.

(Controller Configuration)

Figure 2:
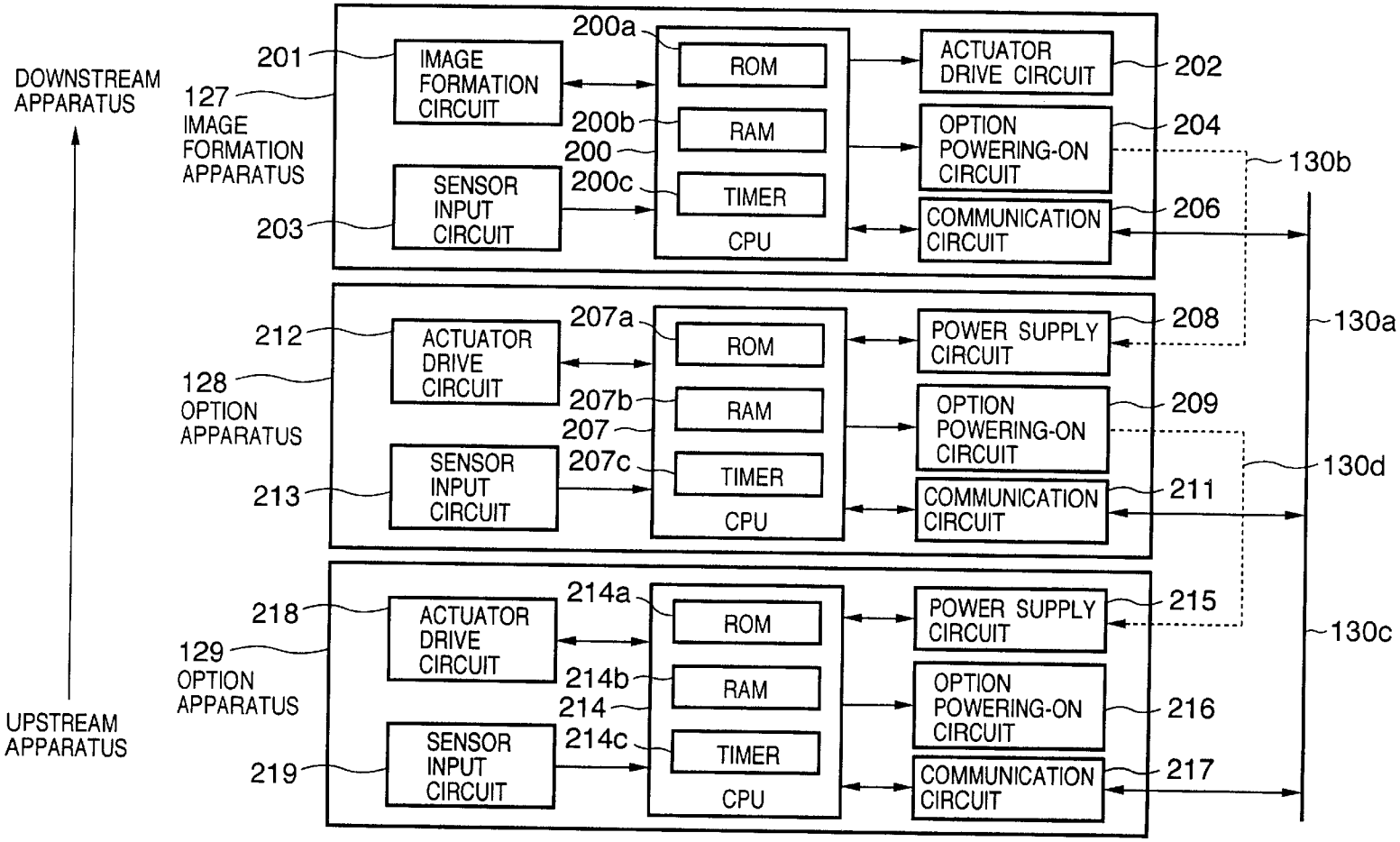
FIG. 2 is a block diagram showing an outlined configuration of the image formation apparatus and controllers in the option apparatuses according to the embodiment of the present invention.

FIG. 2 is a block diagram showing configurations and connection relationships of the controller 127 in the image formation apparatus 100, the controller 128 in the option apparatus 101 and the controller 129 in the option apparatus 102. However, the controllers 143 and 144 in the option apparatuses 133 and 134 have the same configurations as those of the controllers 128 and 129, and therefore these are not shown.

Reference numeral 200 denotes a CPU that is located inside the controller 127 and controls the image formation apparatus to control image formation and sheet transport. The CPU 200 incorporates a ROM 200*a*, a RAM 200*b* and a timer 200*c*. However, the ROM 200*a*, RAM 200*b* and timer 200*c* can also be installed outside the CPU 200.

The ROM 200*a* stores the processing content to be executed by the CPU 200 all the time and software regarding the image formation processing, sheet transport processing and communication processing is written therein.

The RAM 200*b* stores data temporarily required to execute image formation processing, sheet transport processing and communication processing by the CPU 200.

The timer 200*c* generates various timings to execute image formation processing, sheet transport processing and communication processing.

Reference numeral 201 denotes an image formation circuit and is a circuit to carry out electrophotographic process when an image is formed on a sheet by the image formation apparatus.

Reference numeral 202 denotes a circuit to control various actuators (not shown) driven when sheet transport and image formation processing are carried out by the image formation apparatus.

Reference numeral 203 denotes a circuit to input output signals from various sensors (not shown) to the CPU 200 when sheet transport and image formation processing are carried out by the image formation apparatus.

Reference numeral 204 denotes a circuit to carry out processing of turning ON/OFF power from the image formation apparatus to the option apparatuses and controls the power supply circuit of the option apparatus 101 via a power supply control signal line 205.

Reference numeral 206 denotes a circuit to carry out communication processing between the image formation apparatus and option apparatuses and is bus-connected to the option apparatus via a communication line 130*d*. However, the connection mode is not limited to a particular mode.

Reference numerals 207 and 214 denote CPUs that are located in the controller 128 and 129 and control the option apparatuses 101 and 102, respectively to control sheet transport to the image formation apparatus 100. The CPUs 207 and 214 contain ROMs 207*a* and 214*a*, RAMs 207*b* and 214*b* and timers 207*c* and 214*c*. However, the ROMs 207*a* and 214*a*, RAMs 207*b* and 214*b* and timers 207*c* and 214*c* can also be installed outside the CPUs 207 and 214.

The ROMs 207*a* and 214*a* store the processing content to be executed by the CPUs 207 and 214 all the time and software regarding the sheet transport processing and communication processing is written therein.

The RAMs 207*b* and 214*b* store data temporarily required to execute sheet transport processing and communication processing by the CPUs 207 and 214.

The timers 207*c* and 214*c* generate various timings to execute sheet transport processing and communication processing.

Reference numerals 212 and 218 denote circuits to control various actuators (not shown) driven when sheet transport is carried out by the option apparatuses 101 and 102.

Reference numerals 213 and 219 denote circuits to input output signals from various sensors (not shown) to the CPUs 207 and 214 when sheet transport is carried out by the option apparatuses 101 and 102.

Reference numerals 209 and 216 denote circuits to carry out processing of turning ON/OFF power from one option apparatus to the other option apparatus and the circuit 209 controls the power supply circuit of the option apparatus via a power supply control signal line 130*d*.

Reference numerals 211 and 217 denote circuits to carry out communication processing between the image formation apparatus 100 and option apparatuses 101 and 102 and are connected to the option apparatuses via a communication line 130*c*. However, the connection mode is not particularly limited.

(Operation When Power is Turned On)

Figures 3, 3A, 3B, 3C:
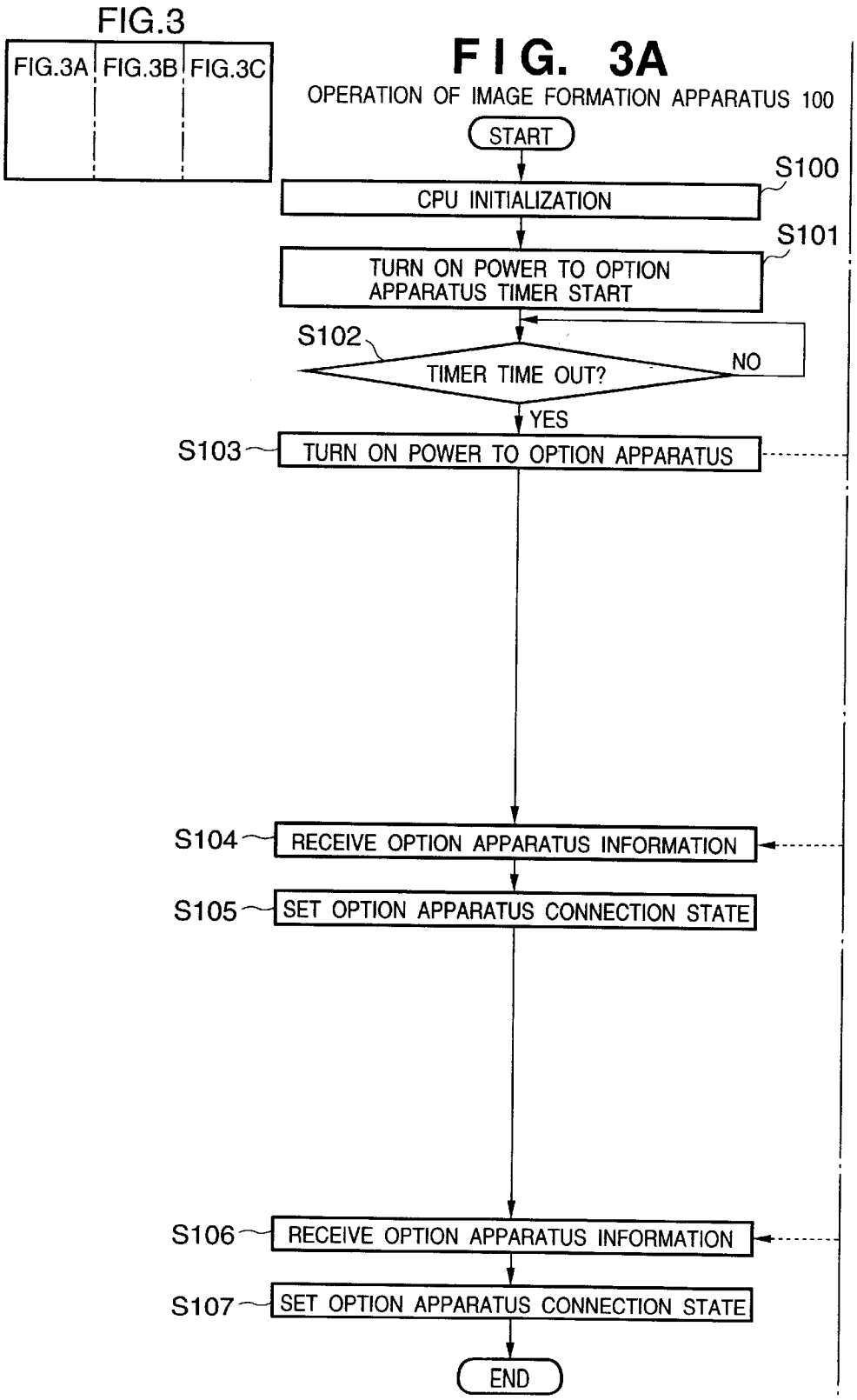
FIGS. 3A to 3C are flow charts showing a powering-on and connection state setting procedure of the image formation apparatus and option apparatuses according to the embodiment of the present invention.
Figure 3B:
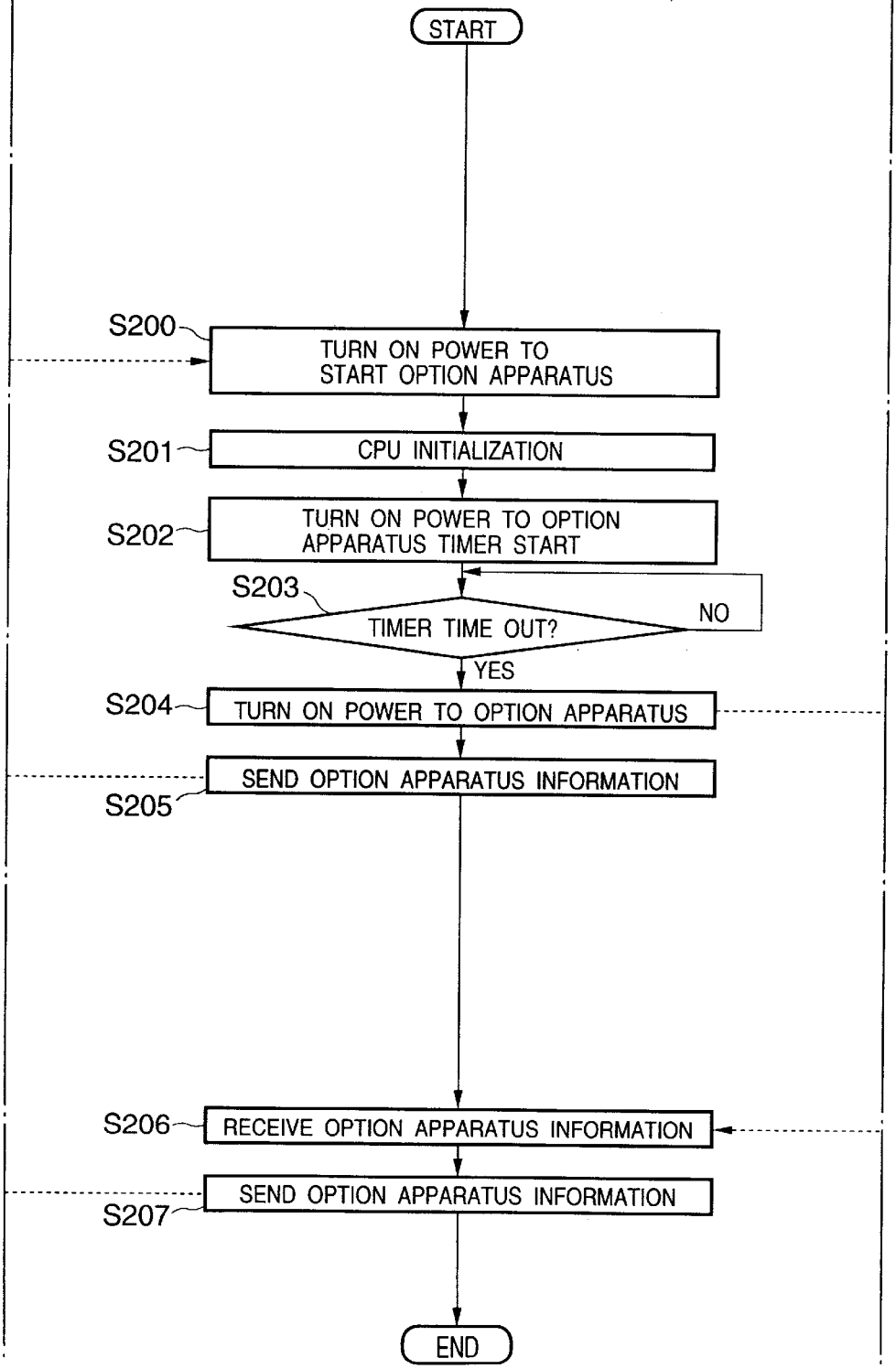
Figure 3C:
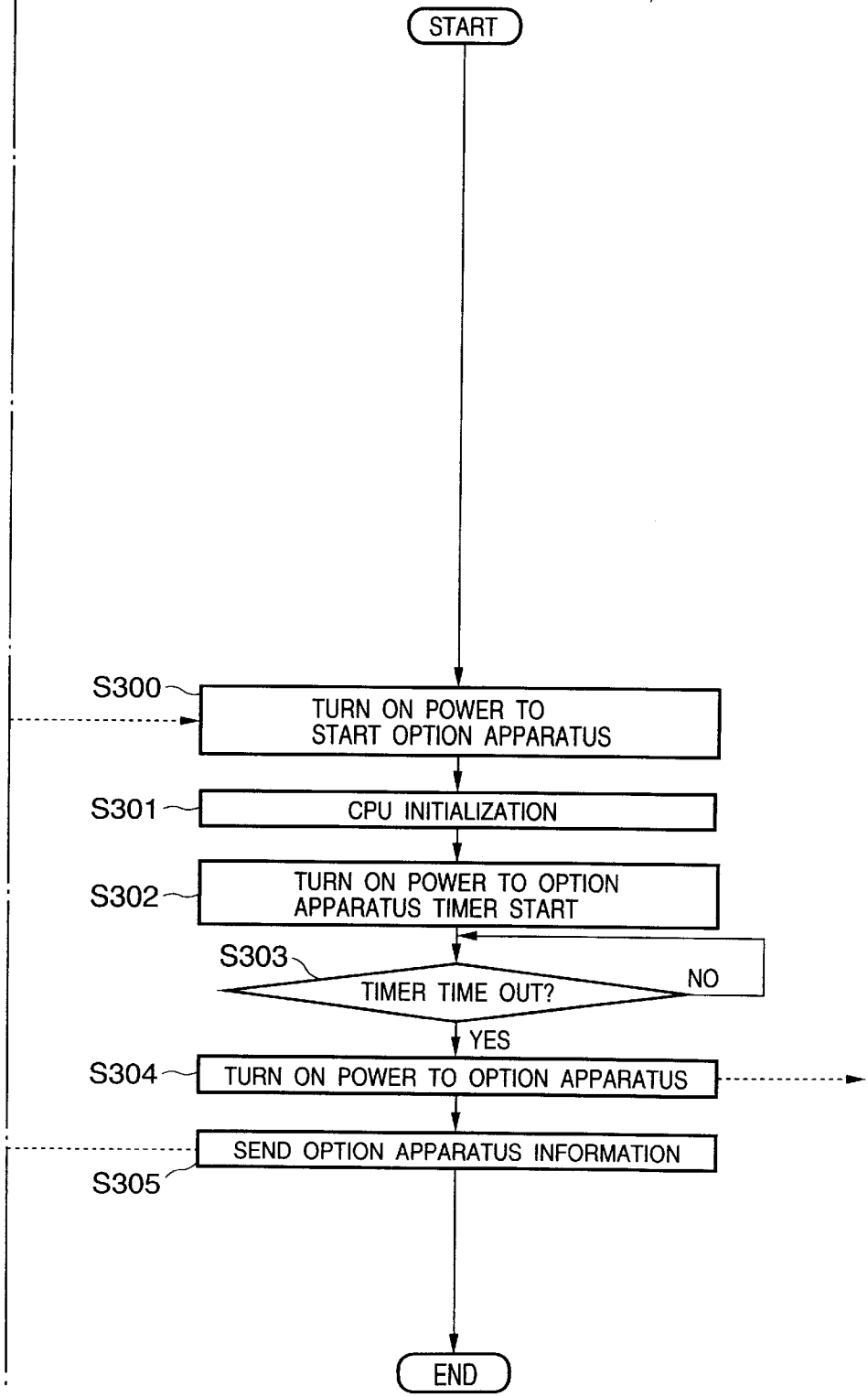

FIGS. 3A to 3C are flow charts showing the processing procedure after the power to the image formation apparatus 100, option apparatuses 101, 102, 133 and 134 is turned on. FIG. 3A, FIG. 3B and FIG. 3C show the operations of the image formation apparatus 100, option apparatuses 101 and 133, and option apparatuses 102 and 134, respectively.

In step S100, immediately after the power to the image formation apparatus 100 is turned on, the CPU 200 is initialized. In the next step S101, the timer 200*c* is started to measure the time until the power to the option apparatus 101 connected is turned on. This is intended to prevent a voltage fluctuation in a surrounding AC line (not shown) caused by turning on power to all apparatuses simultaneously by providing starting time differences and to recognize option apparatuses connected upstream or downstream one by one starting with the option apparatus closest to the image formation apparatus 100.

In step S102, i t is checked with the timer 200*c* start ed in step S101 whether a predetermined time has elapsed or not and if the predetermined time has elapsed, a signal to turn on the power to the option apparatus 101 is output in the next step S103.

On the other hand, in step S200 (FIG. 3B), the option apparatus 101 turns on power by a signal output to the option apparatus 101 and initializes the CPU 207 in the option apparatus 101 in step S201.

In step S202, the timer 207*c* is started to turn on the power to the option apparatus 102 connected upstream from the option apparatus 101.

In step S203, it is checked through the timer 207*c* started in step S200 whether a predetermined time has elapsed or not and if it is confirmed that the predetermined time has elapsed, a signal for turning on the power to the option apparatus 102 located further upstream is output in step S204.

In step S205, the information of the option apparatus 101 is sent to the image formation apparatus 100 through communication processing a predetermined time after the power to the option apparatus 101 is turned on. This transmission content is the information concerning the function and state of the option apparatus 101.

The data sent in step S205 is received by the image formation apparatus 100 (step S104) and the image formation apparatus 100 recognizes in step S105 that the option apparatus 100 is connected one step upstream on the sheet transport path and sets the state of connection with the option apparatus 101 on the RAM 207*b*.

On the other hand, in step S300 (FIG. 3C), the option apparatus 102 receives the power-on signal output by option apparatus 101 in step S204 and turns on the power to the option apparatus 102 and then initializes the CPU 214 in the option apparatus 102 in step S301.

In step S303, the option apparatus performs processing of turning on the power to the option apparatus connected further upstream. Although in this embodiment, no option apparatus is connected further upstream from the option apparatus 102, signals for turning on the power are output also in the configuration having three or more option apparatuses in which further paper feed option apparatuses are connected upstream from the option apparatus 102 .

Then, in step S305, the information of the option apparatus 102 is sent to the downstream option apparatus 101. The option apparatus 101 that has received the information of the option apparatus 102 in step S206 (FIG. 3B) recognizes in step S207 that the option apparatus 102 is connected one step upstream from the option apparatus 101, sets the state of connection with the option apparatus 102 in the RAM 200*b* and transfers the apparatus information of the option apparatus 102 to image formation apparatus 100.

In step S305, it is also possible to configure the option apparatus 102 to directly send the own information to the image formation apparatus 100.

In step S107, the image formation apparatus 100 recognizes that the option apparatus 102 is connected two steps upstream on the sheet transport path and sets the state of connection with the option apparatus 102 in the RAM 200*b*.

Also in the configuration having three or more option apparatuses in which a plurality of paper feed option apparatuses are further connected upstream from the option apparatus 102, the apparatus information is sequentially transmitted to a downstream option apparatus, and the receiving downstream option apparatus retains the apparatus information of the option apparatus connected upstream from it. And, the image formation apparatus 100 sets the apparatus information and the connection states of all the option apparatuses connected upstream from it in the RAM 200*b*.

However, as the processing for setting the state of connection between the option apparatuses 101 and 102, it is also possible to configure the option apparatus 102 to send the information of the own apparatus only to the image formation apparatus 100 without sending it to the option apparatus 101 and configure the image formation apparatus 100 to send the information of the option apparatus 102 to the option apparatus 101.

According to the flow charts shown in FIGS. 3A to 3C, the image formation apparatus 100 can turn on the power to the option apparatus 101 installed one step upstream and the option apparatus 101 can turn on the power to the option apparatus 102 installed one step upstream. Furthermore, the image formation apparatus 100 can recognize the information and connection state of the upstream option apparatuses 101 and 102 and the option apparatus 101 can recognize the information and connection state of the option apparatus 102 one step upstream.

In this embodiment, the option apparatuses 133 and 134 connected downstream from the image formation apparatus 100 operate in the same way as the option apparatuses 101 and 102 except that the powering-on sequence changes from upstream to downstream. That is, by replacing the processing of sequentially turning on power from the image formation apparatus 100 in an upstream direction and sequentially receiving option apparatus information by the processing of sequentially turning on power in a downstream direction and sequentially receiving option apparatus information, it is possible to turn on power to all option apparatuses and recognize the information and connection states.

Furthermore, in the configuration in which a plurality of option apparatuses other than the paper feed option apparatuses 101, 102 and the paper ejection option apparatuses 133, 134 are connected upstream or downstream, the operation is the same.

In this case, it is optional to decide whether to recognize all option apparatuses connected upstream from the image formation apparatus 100 and then recognize option apparatuses connected downstream or vice versa. Furthermore, if the image formation apparatus 100 can receive apparatus information from an upstream option apparatus and apparatus information from a downstream option apparatus independently, it is also possible to turn on power to both apparatuses simultaneously.

(Sheet Transport (Supply) Processing)

FIGS. 4A to 4D and FIGS. 5A to 5C are flow charts that show sheet transport processing of the image formation apparatus 100, option apparatuses 101 and 102, and option apparatus upstream from the option apparatus 102 (not shown in FIG. 1).

Figure 4B:
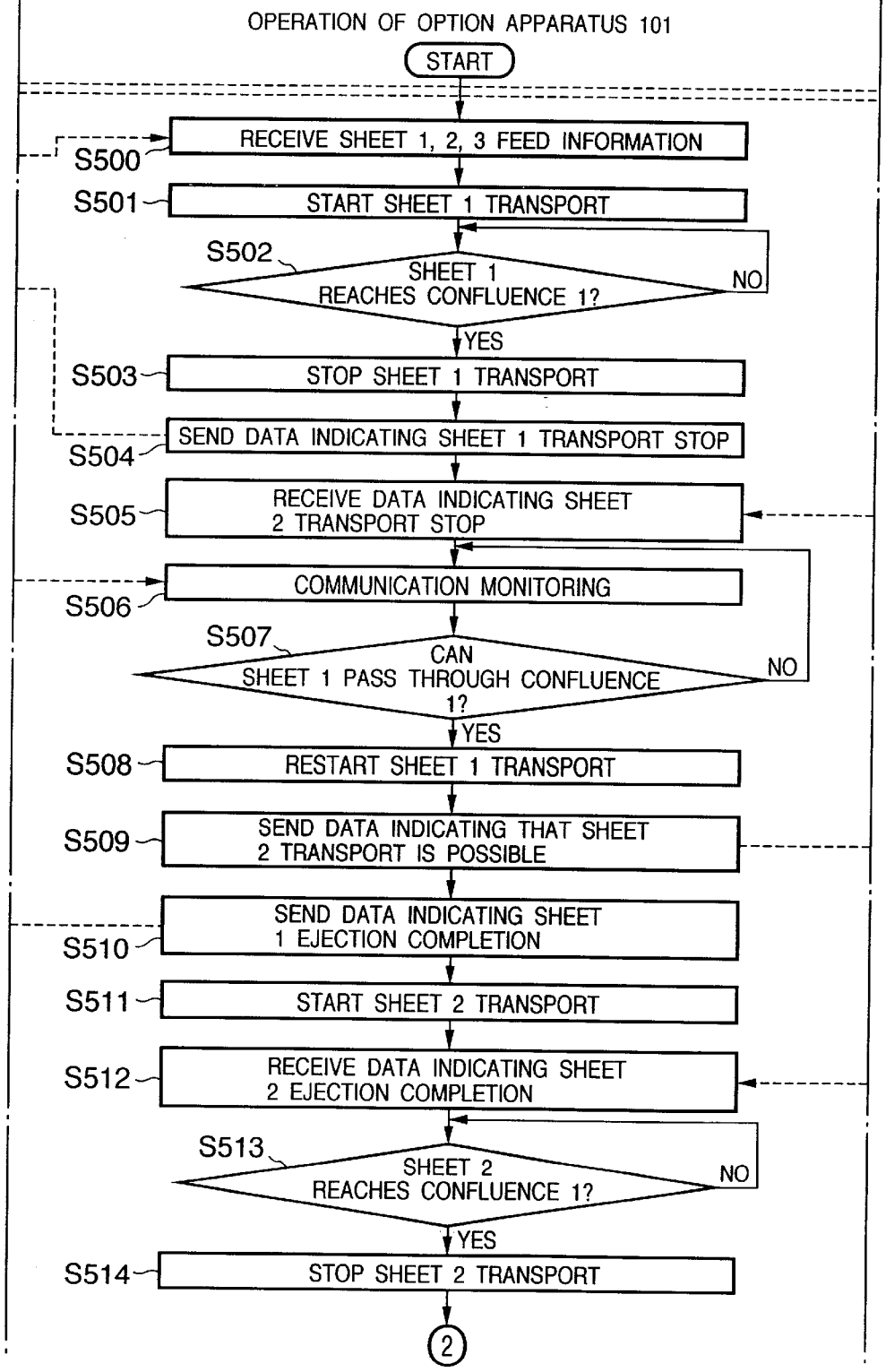
Figure 4C:
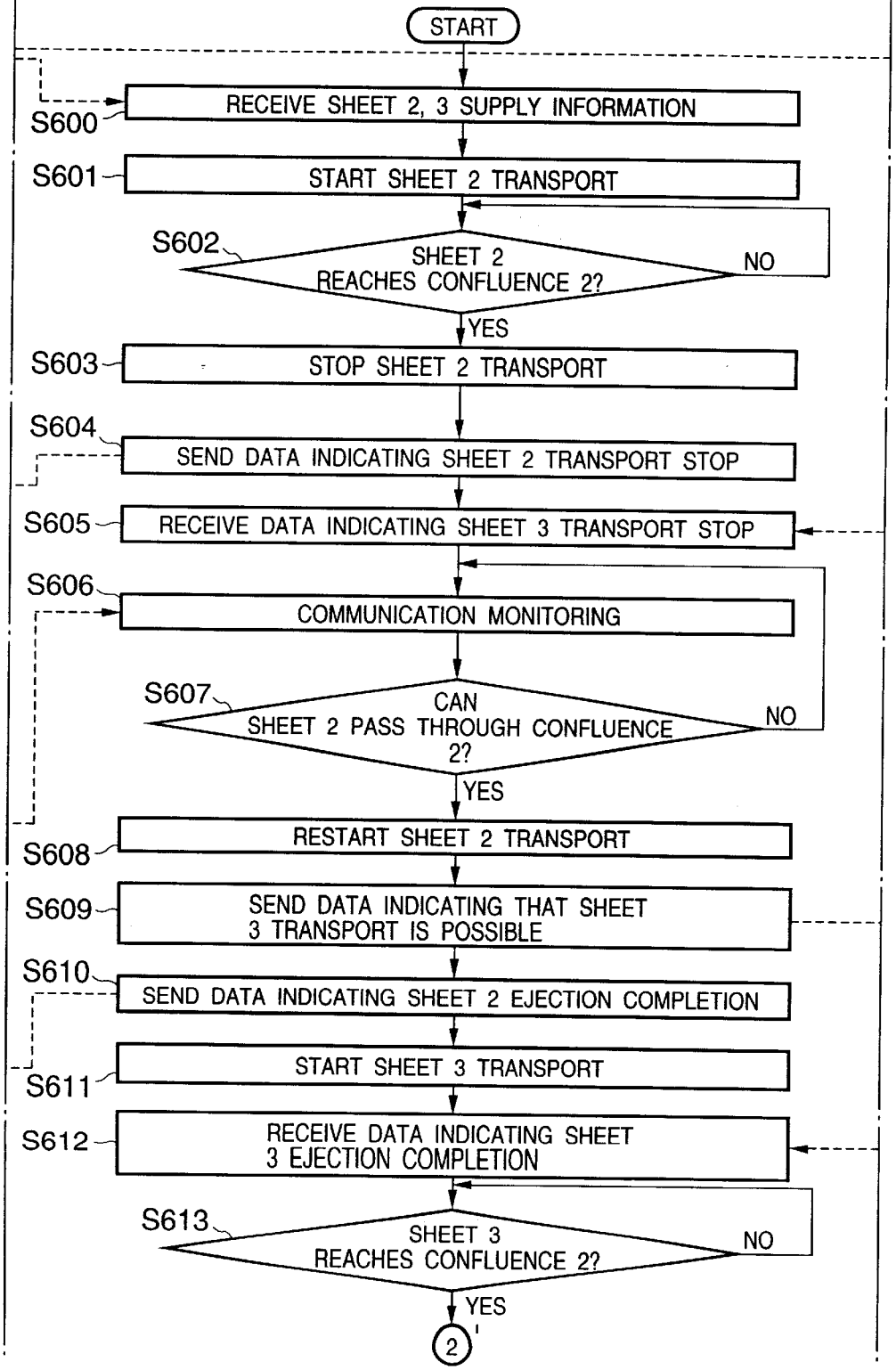
Figure 4D:
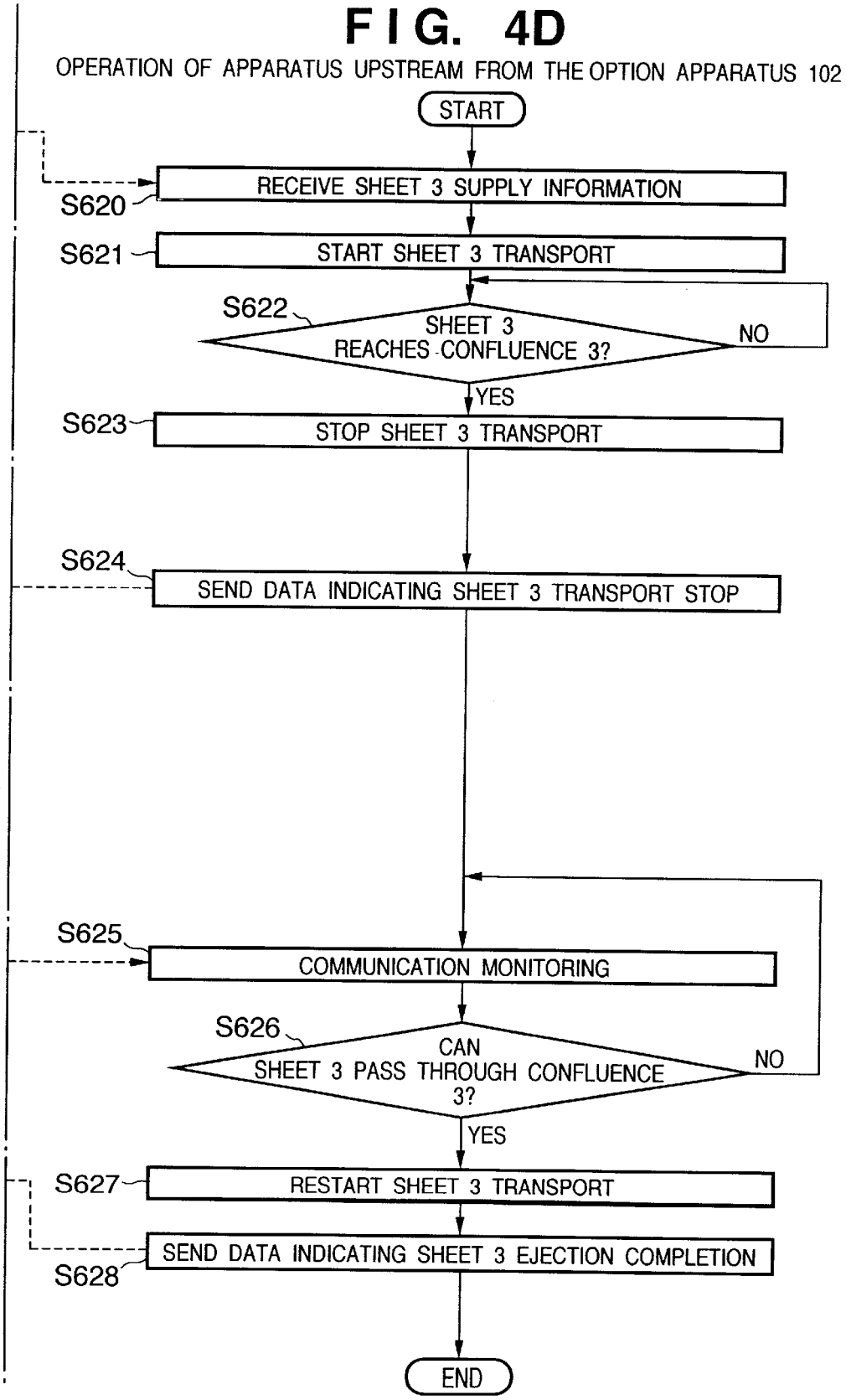
Figure 5B:
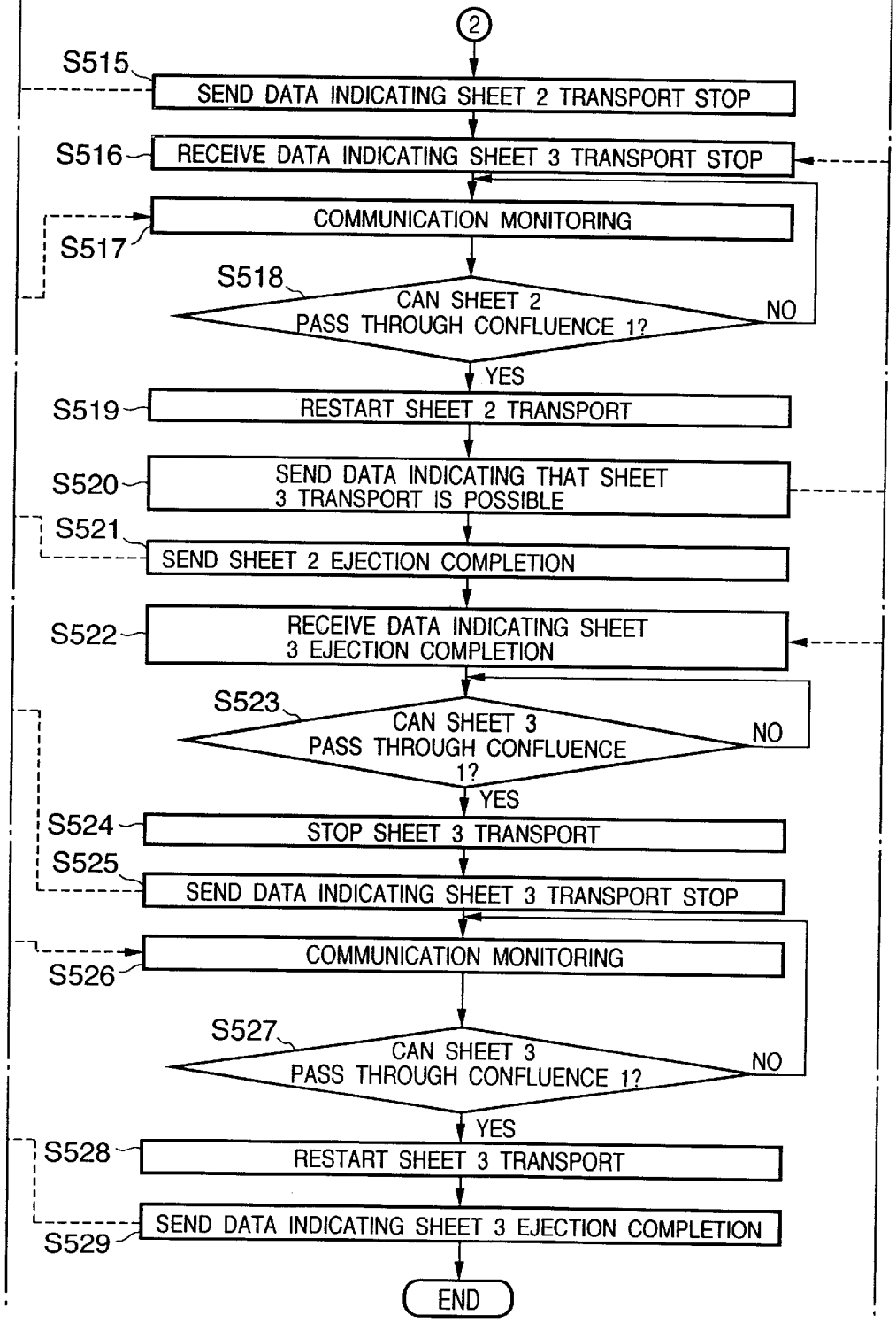
Figure 5C:
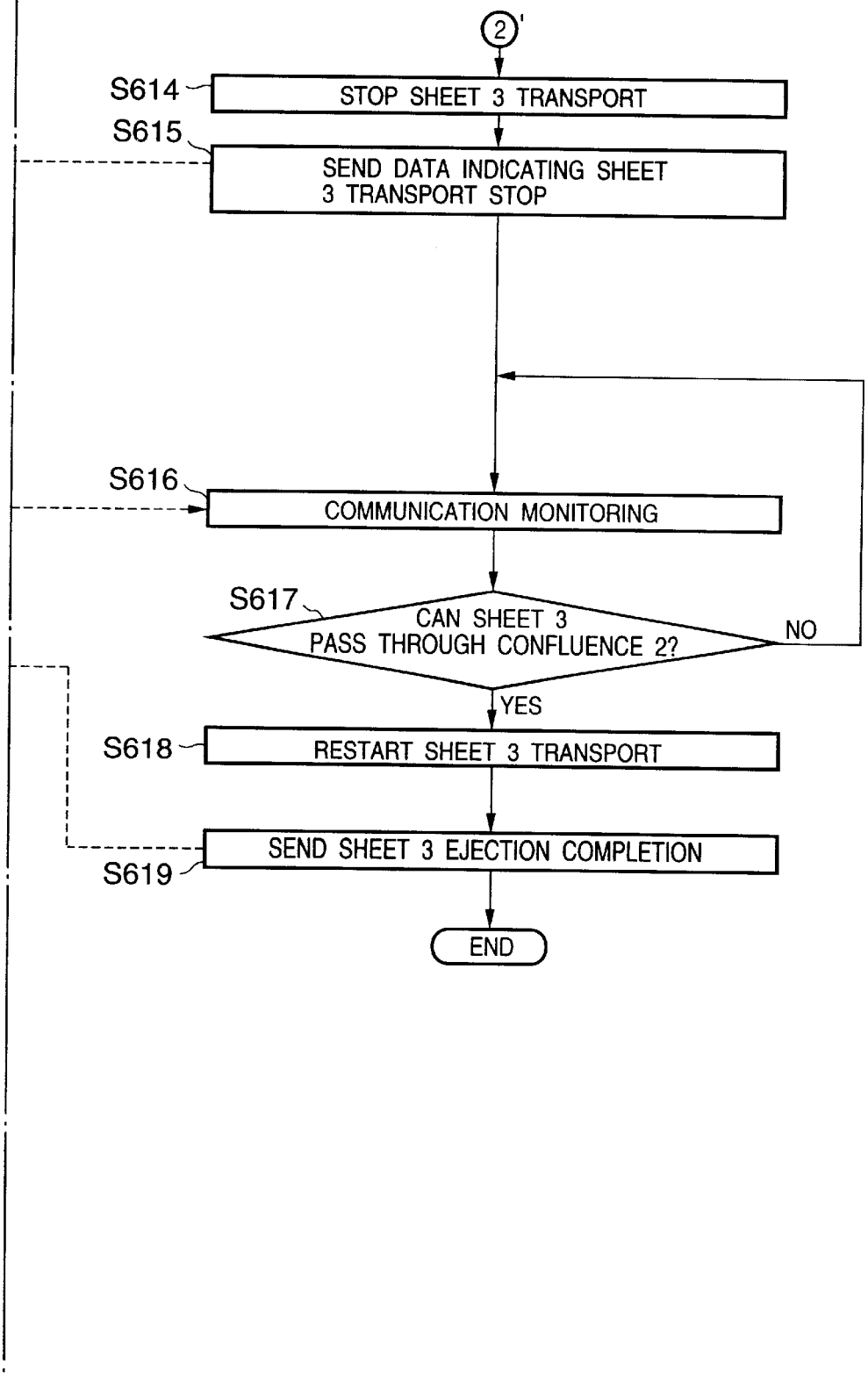

FIG. 4A and FIG. 5A show the operation of the image formation apparatus 100, FIG. 4B and FIG. 5B show the operation of the option apparatus 101, FIG. 4C and FIG. 5C show the operation of the option apparatus 102, and FIG. 4D shows the operation of the option apparatus upstream from the option apparatus 102.

Followings are the description of operations in the case when sheet 1 (sheet 106 in FIG. 1) is fed from the option apparatus 101, sheet 2 (sheet 107 in the same figure) is fed by the option apparatus 102 via the option apparatus 101 to the image formation apparatus 100, and sheet 3 (not shown) is fed by the option apparatus upstream from the option apparatus 102 via the option apparatus 102 and option apparatus 101 to the image formation apparatus 100.

First, in step S400, the image formation apparatus 100 sends sheet transport information to the option apparatuses 101 and 102 and the option apparatus upstream from the option apparatus 102.

Sheet transport information specifies any one of the option apparatuses 101 and 102 and option apparatus upstream from the option apparatus 102 and instructs the specified apparatus to feed sheets, and also instructs the downstream apparatus to transport the sheets. If the option apparatus is instructed to feed a plurality of sheets, each of the option apparatuses is controlled so that the each sheet will be fed to the image formation apparatus 100 in the instructed order.

The option apparatus 101 receives and recognizes the transport information of sheets 1, 2, and 3 from the image formation apparatus 100 in step S500. The option apparatus 101 also stores the received transport information of sheets 1, 2, and 3 in the RAM 207*b*. Since the option apparatus 101 transports sheet 2 from the option apparatus 102, it receives the transport information of sheet 2. In addition, since the option apparatus 101 transports sheet 3 from the option apparatus upstream from the option apparatus 102, it receives the transport information of sheet 3. The option apparatus 101 then starts to transport sheet 1 (step S501). In addition, the option apparatus 101 starts the timer 207*c*. In the following, the timers in the respective apparatuses are set for determining the timing of transport of sheets in transporting the respective sheets, and are used for transport control.

On the other hand, the option apparatus 102 receives and recognizes the transport information of sheet 2 from the image formation apparatus 100 in step S600, and since the option apparatus 102 transports sheet 3 from the option apparatus upstream from it, it receives the transport information of sheet 3. The option apparatus 102 also stores the received transport information of sheets 2 and 3 in the RAM 214*b*. The option apparatus 102 then starts to transport sheet 2 (step S601). In addition, the option apparatus 102 starts the timer 214*c*.

When the option apparatus 101 starts to transport sheet 1 in step S501, the image formation apparatus 100 checks the transport of sheet 1 according to the sensor information input from the sensor input circuit 203 when sheet 1 is transported to the image formation apparatus 100 and starts transport control (step S401). Alternatively, the image formation apparatus 100 may have been driven the roller pair 118 so as to transport sheet 1 without detection of the sensor signal.

In step S502, the option apparatus 101 determines with the timer 207*c* whether sheet 1 has reached the confluence (1) 131 just before the roller pair 117 or not and if sheet 1 has reached the confluence, the option apparatus 101 stops the transport of sheet 1 in step S503. However, if no other sheet exists at the confluence (1) 131, it is possible to continue to transport sheet 1 without stopping.

Then, in step S504, the option apparatus 101 sends data to notify the image formation apparatus 100 of the stoppage of transport of sheet 1 and in step S402, the image formation apparatus 100 receives and recognizes the data indicating that the transport of sheet 1 has been stopped. The image formation apparatus 100 also stops the transport of sheet 1 in the image formation apparatus 100.

The option apparatus 102 that started the transport of sheet 2 in step S601 determines with the timer 214*c* in step S602 whether sheet 2 has reached the confluence (2) 132 just before the roller pair 119 or not and if sheet 2 has reached the confluence, the option apparatus 102 stops the transport of sheet 2 in step S603. However, if no other sheet exists at the confluence (2) 132, it is possible to continue to transport sheet 2 without stopping.

Then, the option apparatus 102 sends the data to notify the stoppage of transport of sheet 2 to the option apparatus 101 in step S604. This data is received by the option apparatus 101 (step S505) and the option apparatus 101 recognizes that the transport of sheet 2 has been stopped.

In step S403, the image formation apparatus 100 determines whether sheet 1 can pass through the confluence (1) 131 in the image formation apparatus 100 or not and if sheet 1 can pass through the confluence, the image formation apparatus 100 moves on to step S404 and sends to the option apparatus 101 the data to indicate that it is possible to transport sheet 1.

In step S506 and step S507, the option apparatus 101 monitors communication data, and when it is determined that the data output by the image formation apparatus 100 in step S404 shows that sheet 1 can pass through the confluence (1) 131, the option apparatus 101 moves on to step S508.

In step S508, the processing of transporting sheet 1 in the option apparatus 101 restarts, and in step S405, the processing of transporting sheet 1 in the image formation apparatus 100 restarts.

When sheet 2 is allowed to pass through the confluence (2) 132 just before the roller pair 119, the option apparatus 101 sends the data indicating that sheet 2 can pass through the confluence to the option apparatus 102 (step S509). The option apparatus 102 monitors the communication in order to detect whether sheet 2 whose transport has been stopped in step S604 is allowed to pass through the confluence (2) 132 or not (steps S606, S607), and after confirming the reception of the data indicating that sheet 2 is allowed to pass through the confluence (2) 132 from the option apparatus 101, the option apparatus 102 restarts to transport sheet 2 in step S608.

When sheet 1 is ejected from the option apparatus 101, data indicating the completion of ejection of sheet 1 is sent to the image formation apparatus 100 (step S510) and the image formation apparatus 100 receives and recognizes sheet 1 ejection completion data in step S406.

Then, the image formation apparatus 100 performs image formation processing on sheet 1 transported into the image formation processing 100 in step S407.

On the other hand, the option apparatus 101 that has completed the ejection of sheet 1 starts to transport sheet 2 transported from the option apparatus 102 to the option apparatus 101 (step S511).

When the ejection of sheet 2 is completed, the option apparatus 102 sends the data indicating the completion of ejection of sheet 2 to the option apparatus 101 in step S610 and the option apparatus 101 receives the data indicating the completion of ejection of sheet 2 in step S512.

In step S408, when the image formation apparatus 100 detects through a signal from the sensor input circuit 203 that sheet 2 has been transported to the image formation apparatus 100, the image formation apparatus 100 starts to transport sheet 2. Alternatively, the image formation apparatus 100 may have been driven the roller pair 118 so as to transport sheet 2 without detection of the sensor signal.

In step S513, the option apparatus 101 determines whether sheet 2 has reached the confluence (1) 131 just before the roller pair 117 and if sheet 2 has reached the confluence, the option apparatus 101 stops the transport of sheet 2 in step S514 (FIG. 5B). However, if there is no other sheet at the confluence (1) 131, the option apparatus 101 can also continue to transport sheet 2 without stopping.

In step S515, the option apparatus 101 sends data to notify the image formation apparatus 100 of the stoppage of transport of sheet 2 and the image formation apparatus 100 receives and recognizes this data indicating the stoppage of transport of sheet 2. Then, the image formation apparatus 100 stops transporting sheet 2 in the image formation apparatus 100 (step S409).

In step S410, the image formation apparatus 100 determines whether sheet 2 can pass through the confluence (1) 131 in the image formation apparatus 100 or not and if sheet 2 can pass through the confluence, the image formation apparatus 100 moves on to step S411 and sends to the option apparatus 101 data indicating that it is possible to transport sheet 2.

In step S517, the option apparatus 101 monitors communication data, and when it is determined in step S518 that sheet 2 can pass through the confluence (1) 131, the option apparatus 101 moves on to step S519.

In step S519, the option apparatus 101 restarts the processing of transporting sheet 2 in the option apparatus 101, and in step S412, the image formation apparatus 100 also restarts the processing of transporting sheet 2.

In step S521, when the option apparatus 101 ejects sheet 2, the data indicating the completion of ejection of sheet 2 is sent to the image formation apparatus 100 through communication processing.

The image formation apparatus 100 that has received this data in step S413 performs image formation processing on sheet 2 in step S414.

The transport control for sheets 1 and 2 has been explained in the above description. As with sheet 2, sheet 3 is sequentially transported from the option apparatus located upstream from the option apparatus 102 to the option apparatus 102 one step downstream from the option apparatus, to the option apparatus 101 further downstream, and then to the image formation apparatus 100, as shown in steps S620 to S628. Eventually, in steps up to steps S419, S529, and S619, sheet 1, 2, and 3 are transported to the image formation apparatus 100 in this order, and image formation is conducted.

According to sheet transport and monitoring processing shown in the flow charts in FIGS. 4A to 4D and FIGS. 5A to 5C, the image formation apparatus 100 first sends sheet transport information to all of the connected option apparatuses 101 and 102 and option apparatus upstream from the option apparatus 102, and performs sheet transport control and monitoring of only the option apparatus 101 one step upstream after sheet transport processing is started, the option apparatus 101 performs sheet transport control and monitoring of only the option apparatus 102 one step upstream, and the option apparatus 102 performs sheet transport control and monitoring of only the option apparatus one step upstream, and in this way it is possible to carry out image formation processing and transport processing on all sheets.

Furthermore, also in the configuration in which a plurality of paper feed option apparatuses are further connected upstream, each apparatus performs sheet transport control and monitoring of the option apparatus one step upstream from itself, thus making it possible to carry out image formation processing and transport processing on all sheets.

(Sheet Transport (Ejection) Processing)

FIGS. 6A to 6C and FIGS. 7A to 7C are flow charts to show sheet transport processing of the image formation apparatus 100, option apparatuses 133 and 134.

Figures 6, 6A, 6B, 6C:
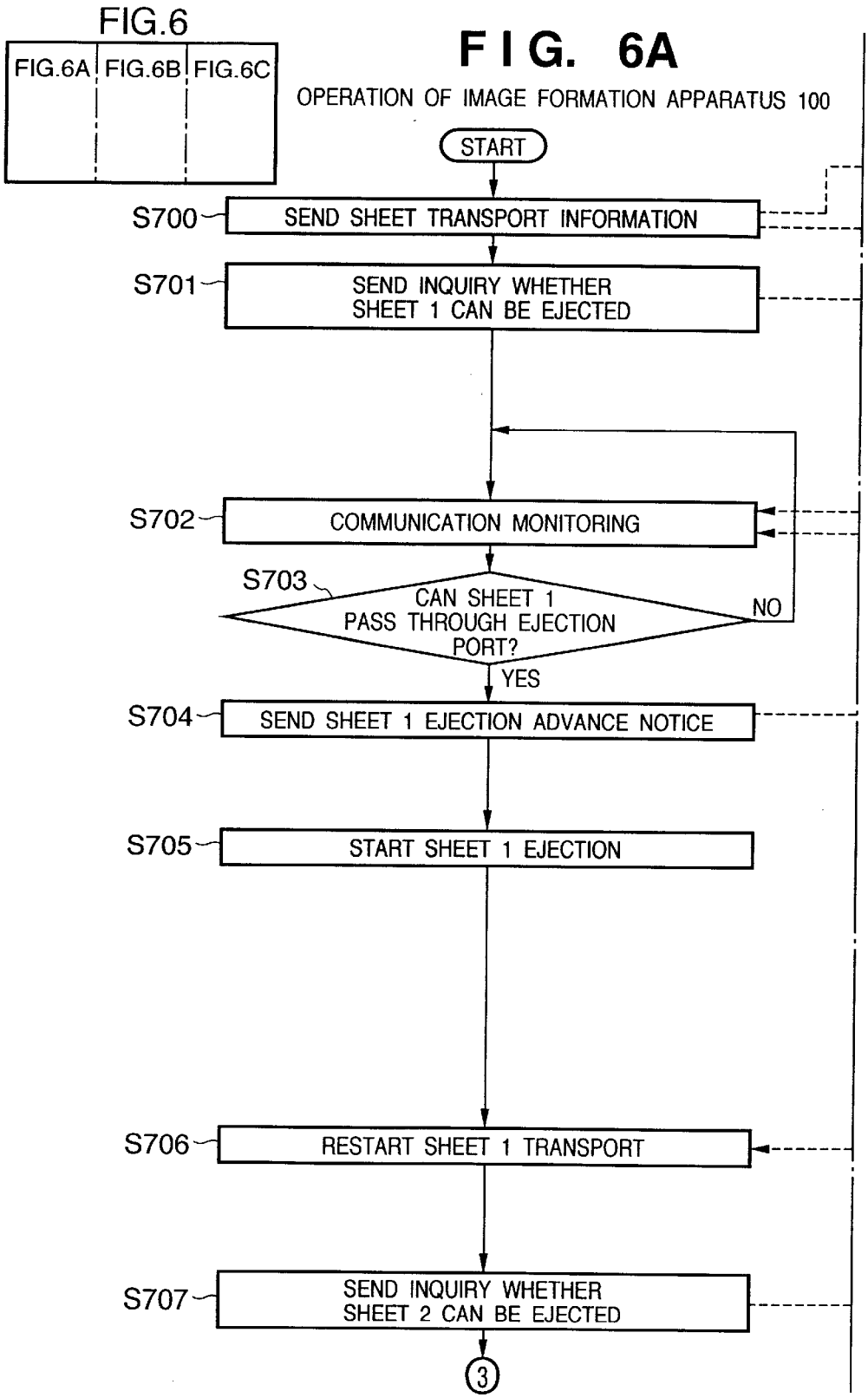
FIGS. 6A to 6C are flow charts showing sheet transport processing procedure of the image formation apparatus and option apparatuses according to the first embodiment of the present invention.
Figure 6B:
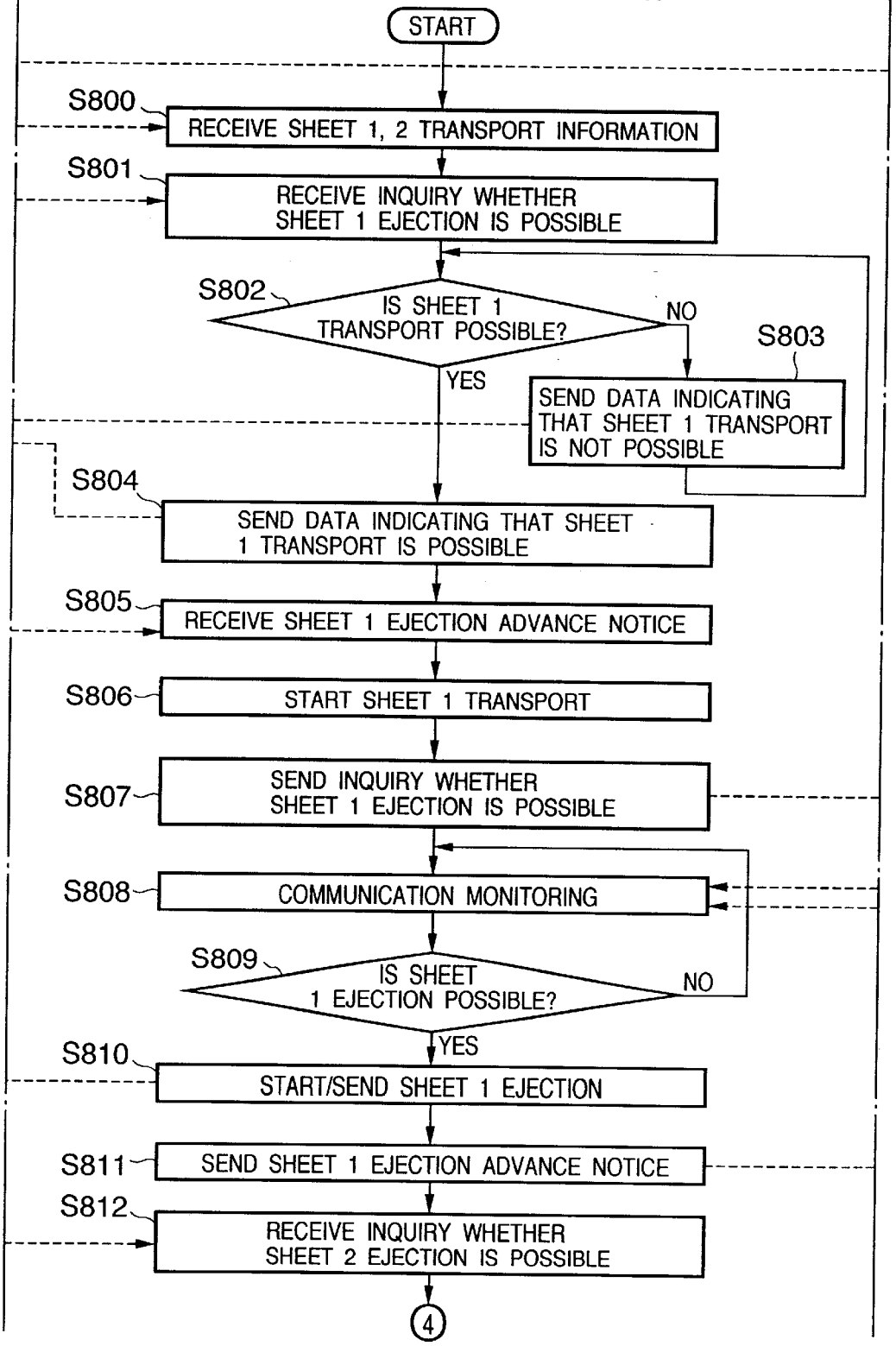
Figure 6C:
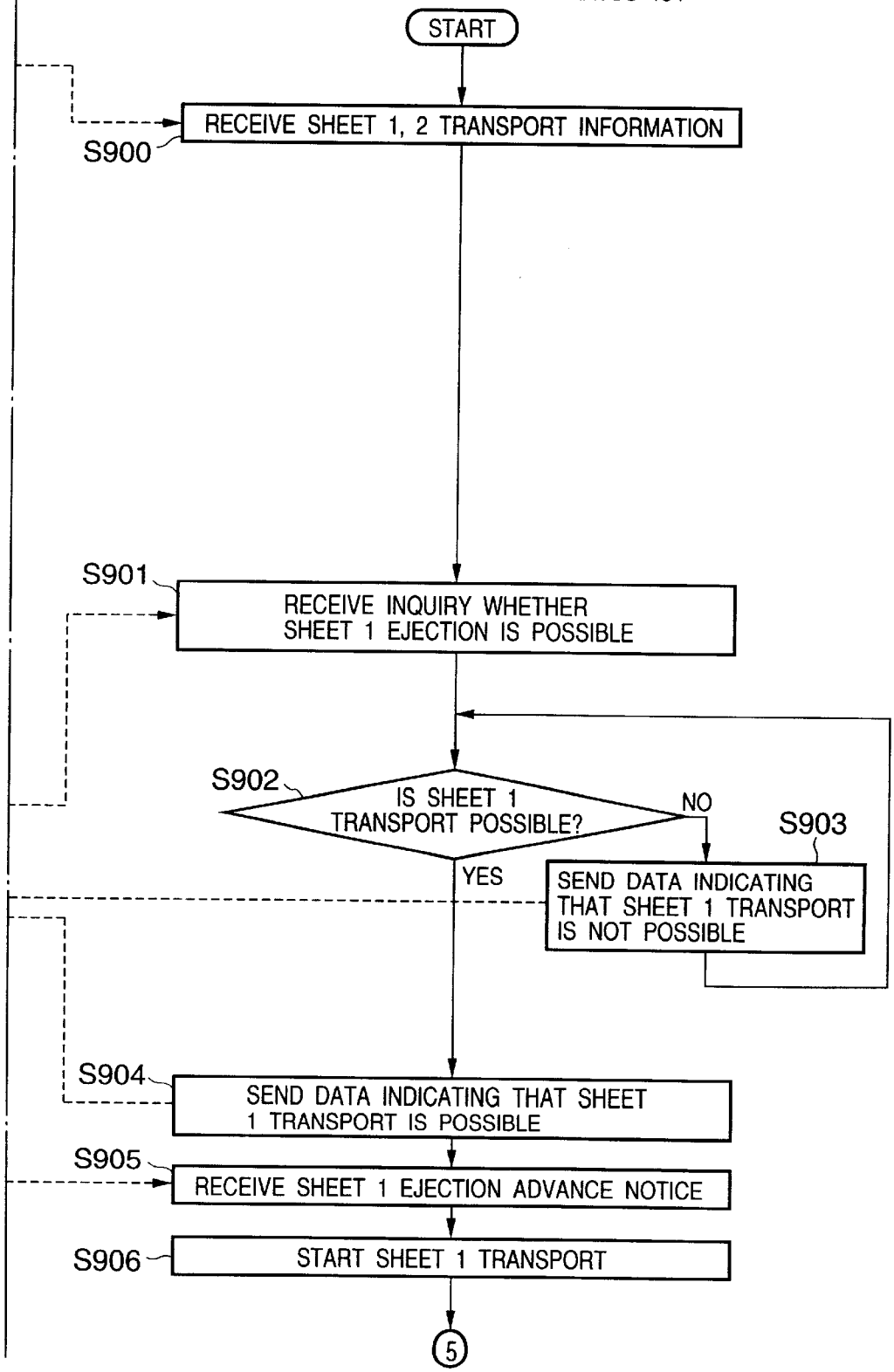
Figure 7B:
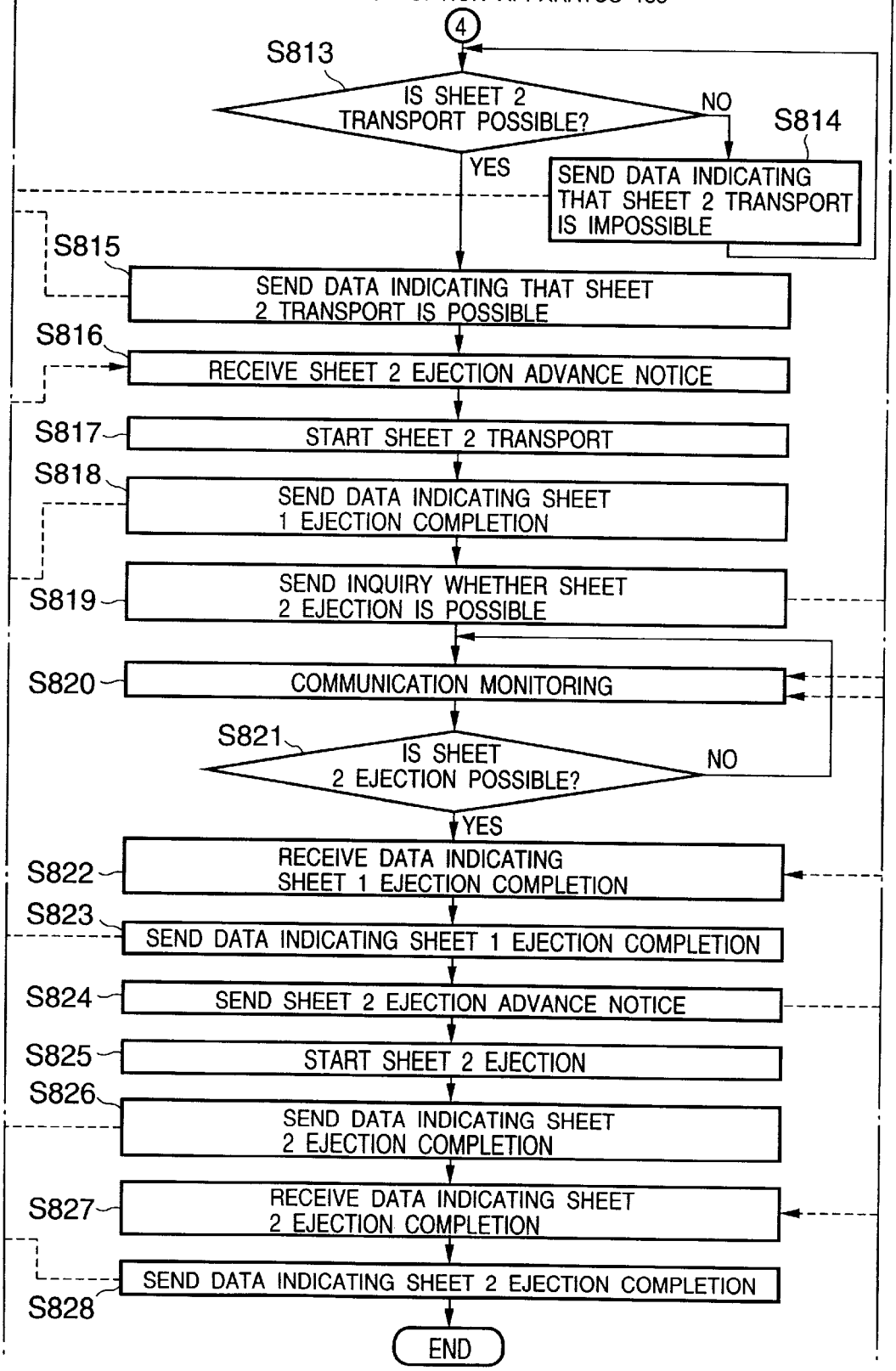
Figure 7C:
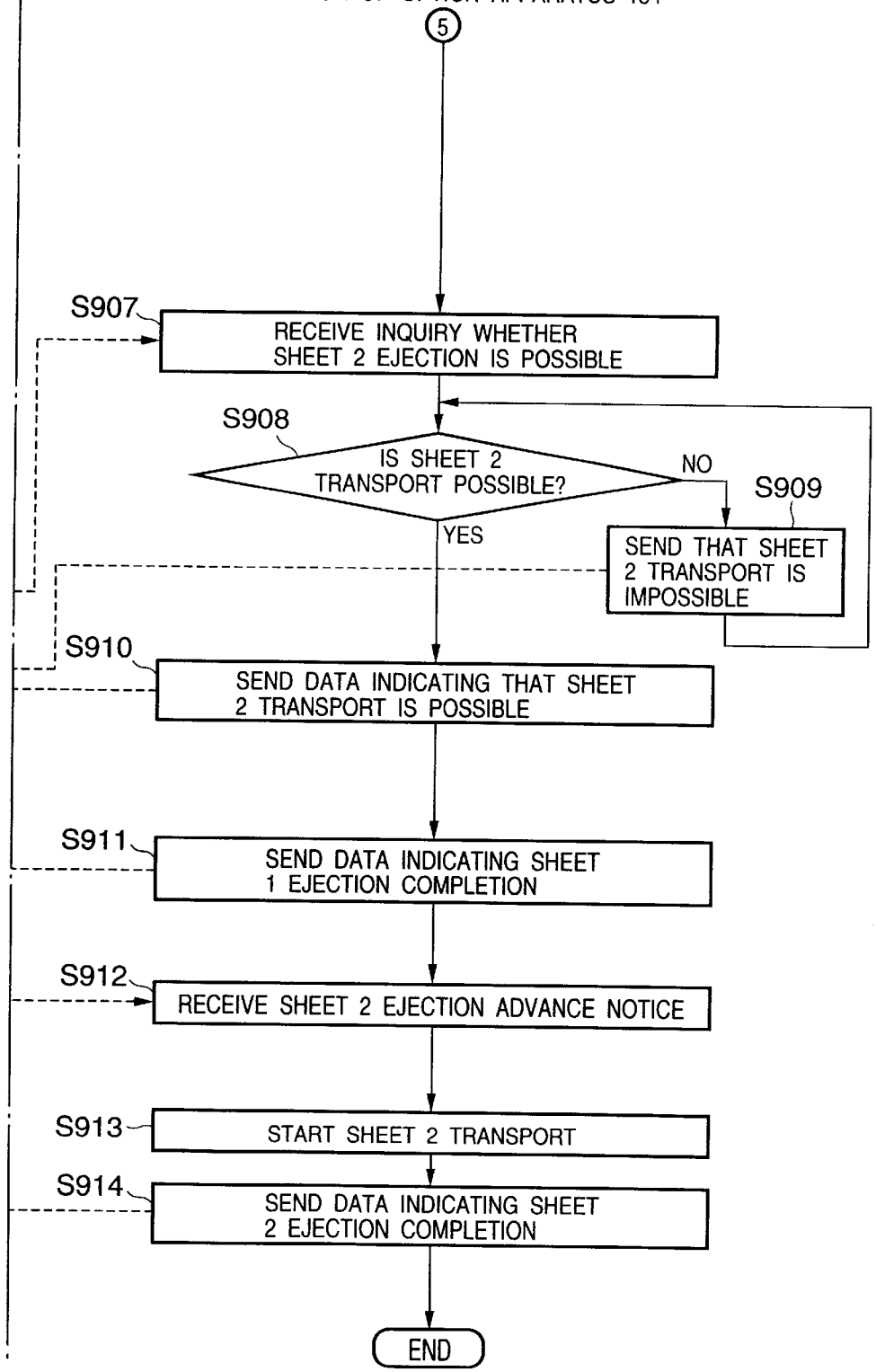

FIG. 6A and FIG. 7A show the operation of the image formation apparatus 100, FIG. 6B and FIG. 7B show the operation of the option apparatus 133 and FIG. 6C and FIG. 7C show the operation of the option apparatus 134.

Followings are the description of the operation in case when the sheets 1 and 2 are transported from the image formation apparatus 100 through the option apparatus 133 to the option apparatus 134 at which the sheets 1 and 2 are ejected and loaded.

First, in step S700, the image formation apparatus 100 sends sheet transport information to the option apparatuses 133 and 134. Sheet transport information instructs sheet ejection and load by specifying the option apparatus to which the sheet(s) is(are) to be loaded, and also instructs the downstream apparatus to transport the sheets.

The sheet transport information is received by the option apparatuses 133 and 134 in step S800 and step S900, respectively.

In step S701, data is sent to inquire whether it is possible to eject sheet 1 to the option apparatus 133 connected right downstream from the image formation apparatus 100. The option apparatus 133 receives this inquiry data in step S801 and determines whether it is possible to transport sheet 1 in step S802. If it is impossible to transport the sheet, the option apparatus 133 notifies this to the image formation apparatus 100 in step S803 and if it is determined that it is possible to transport the sheet, the option apparatus 133 notifies this to the image formation apparatus 100 in step S804. These notifications are both received by the image formation apparatus 100, which is monitoring the communication (step S702).

Based on the notification received in step S702, the image formation apparatus 100 determines in step S703 whether sheet 1 can pass through the ejection port 125 of the image formation apparatus 100 or not and if sheet 1 can pass through the ejection port 125, the image formation apparatus 100 moves on to step S704. On the other hand, if sheet 1 cannot pass through the ejection port 125, the image formation apparatus 100 continues communication monitoring processing in step S702 until the option apparatus 133 notifies that it is possible to transport the sheet.

In step S704, the image formation apparatus 100 sends an advance notice that sheet 1 will be ejected to the option apparatus 133, and then in step S705, the image formation apparatus 100 starts to eject sheet 1. The option apparatus 133 receives the advance notice of ejection of sheet 1 in step S805 and then starts to transport sheet 1 in step S806.

Then, in step S807, the option apparatus 133 inquires the option apparatus 134 located downstream about whether sheet 1 being transported in the option apparatus 133 can be ejected or not.

This inquiry data is received by the option apparatus 134 in step S901, and it is determined in step S902 whether sheet 1 can be transported or not. If sheet 1 cannot be transported, the option apparatus 134 notifies this to the option apparatus 133 in step S903. If sheet 1 can be transported, the option apparatus 134 notifies that sheet 1 can be transported in step S904.

The option apparatus 133 monitors the communication in step S808 and determines in step S809 whether sheet 1 can be ejected or not based on the notification received from the option apparatus 134. If sheet 1 can be ejected, the option apparatus 133 moves on to the next step S810, notifies the image formation apparatus 100 of the start of the ejection of sheet 1. Then, in the following step S811, the option apparatus 133 sends the option apparatus 134 an advance notice of ejection before sheet 1 is ejected from the option apparatus 133.

Upon reception of the advance notice of ejection from the option apparatus 133 in step S905, the option apparatus 134 starts to transport sheet 1 transported to the option apparatus 134 (step S906).

When the ejection of sheet 1 is completed, for example, the image formation apparatus 100 inquires the option apparatus 133 whether it is possible to eject sheet 2 or not (step S707).

The option apparatus 133 receives this inquiry in step S812 and determines in step S813 whether the option apparatus 133 can transport sheet 2 or not. If sheet 2 cannot be transported for such a reason that the processing of sheet 1 is in progress, the option apparatus 133 notifies this to the image formation apparatus 100 in step S814. If sheet 2 can be transported, the option apparatus 133 notifies that sheet 2 can be transported to the image formation apparatus 100 in step S815. This determination result of the option apparatus 133 is received by the image formation apparatus 100 in step S708 and the image formation apparatus 100 determines whether sheet 2 can pass through the ejection port 125 or not based on the received determination result (step S709). If it is determined that sheet 2 cannot pass through the ejection port 125, the image formation apparatus 100 waits until it is determined that sheet 2 is allowed to pass through the ejection port 125. On the other band, if the image formation apparatus 100 is notified from the option apparatus 133 that sheet 2 can pass through the ejection port 125, the image formation apparatus 100 sends an advance notice of sheet ejection to the option apparatus 133 in step S710. This notice is received by the option apparatus 133 in step S816 and the option apparatus 133 recognizes the advance notice of the ejection of sheet 2.

Following the advance notice of the ejection of sheet 2, the image formation apparatus 100 starts to eject sheet 2 in step S711 and the option apparatus 133 also starts to transport sheet 2 in step S817.

In step S818, the completion of ejection of sheet 1 in the option apparatus 133 is notified to the image formation apparatus 100 and received and recognized by the image formation apparatus 100 in step S712. Then, the option apparatus 133 inquires the option apparatus 134 in step S819 about whether sheet 2 can be ejected or not.

This inquiry is received by the option apparatus 134 in step S907 and the option apparatus 134 determines in step S908 whether sheet 2 can be transported or not. The determination result is notified to the option apparatus 133 in step S909 if sheet 2 cannot be transported or in step S910 if sheet 2 can be transported.

In step S820, the option apparatus 133 receives from the option apparatus 134 the determination result of whether it is possible to transport sheet 2 or not. Then, in step S821, the option apparatus 133 determines whether the option apparatus 134 has notified as to whether sheet 2 can be ejected or not and waits until the notification is received.

When the preceding sheet 1 is ejected from the option apparatus 134, the option apparatus 134 notifies this to the option apparatus 133 (step S911). In step S822, upon reception of a notice that the option apparatus 134 has completed the transport of sheet 1, the option apparatus 133 notifies the image formation apparatus 100 in step S823 that sheet 1 has been ejected from the option apparatus 134 and sends an advance notice of ejection of sheet 2 to the option apparatus 134 in step S824.

The option apparatus 134 receives and recognizes the advance notice of ejection of sheet 2 from the option apparatus 133 in step S912. Then, in step S913, the option apparatus 134 starts to transport sheet 2 based on the advance notice of ejection received in step S912.

On the other hand, in step S825, the option apparatus 133 starts to eject sheet 2 following the advance notice of the ejection output in step S824. When the transport of sheet 2 in the option apparatus 133 is completed, the option apparatus 133 notifies this to the image formation apparatus 100 in step S826. The image formation apparatus 100 receives and recognizes this notice in step S714.

When the ejection of sheet 2 is completed, the option apparatus 134 notifies this to the option apparatus 133 and completes the processing in step S914. Upon reception of the notice of the completion of ejection of sheet 2 by the option apparatus 134 in step S827, the option apparatus 133 notifies the image formation apparatus 100 that the option apparatus 134 has ejected sheet 2 in step S828. Then, the image formation apparatus 100 receives and recognizes the completion of ejection of sheet 2 by the option apparatus 134 in step S715 and a series of ejection processing is completed.

According to sheet transport control and monitoring processing shown in the flow charts in FIGS. 6A to 6C and FIGS. 7A to 7C, the image formation apparatus 100 first sends sheet transport information to all the connected option apparatuses 133 and 134, performs sheet transport control and monitoring of only the option apparatus 133 one step downstream after sheet transport processing is started and the option apparatus 133 performs sheet transport control and monitoring of only the option apparatus 134 one step downstream, thus making it possible to carry out image formation processing and transport processing on all sheets.

Furthermore, also in the configuration in which a plurality of paper ejection option apparatuses other than the paper ejection apparatuses 133, 134 are connected downstream, each apparatus performs sheet transport control and monitoring of the option apparatus one step downstream from itself, thus making it possible to carry out transport processing on all sheets, on which images are formed.

Second Embodiment

Figures 8, 8A, 8B, 8C:
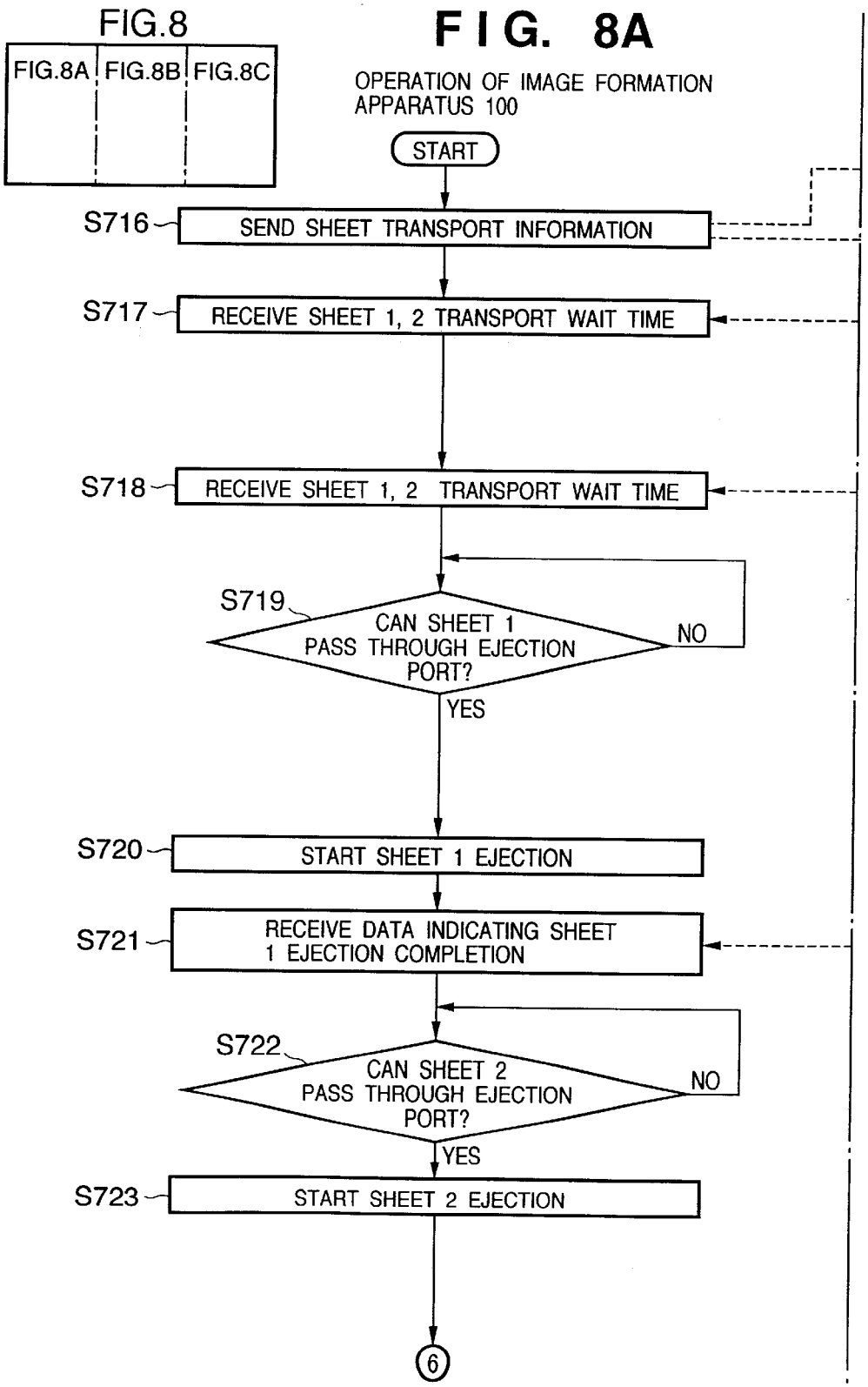
FIGS. 8A to 8C are flow charts showing a sheet transport processing procedure of an image formation apparatus and option apparatuses according to a second embodiment of the present invention.
Figure 8B:
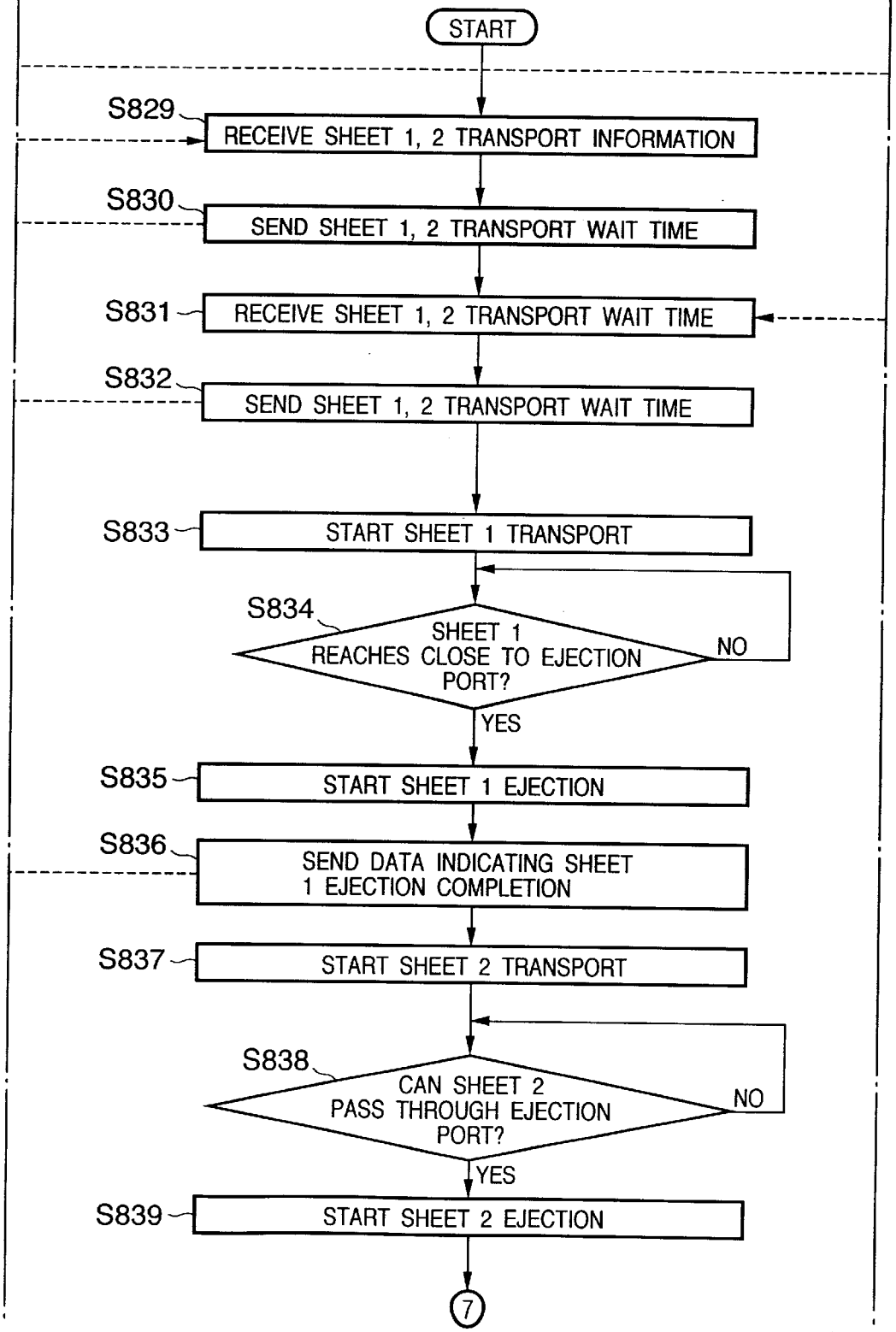
Figure 8C:
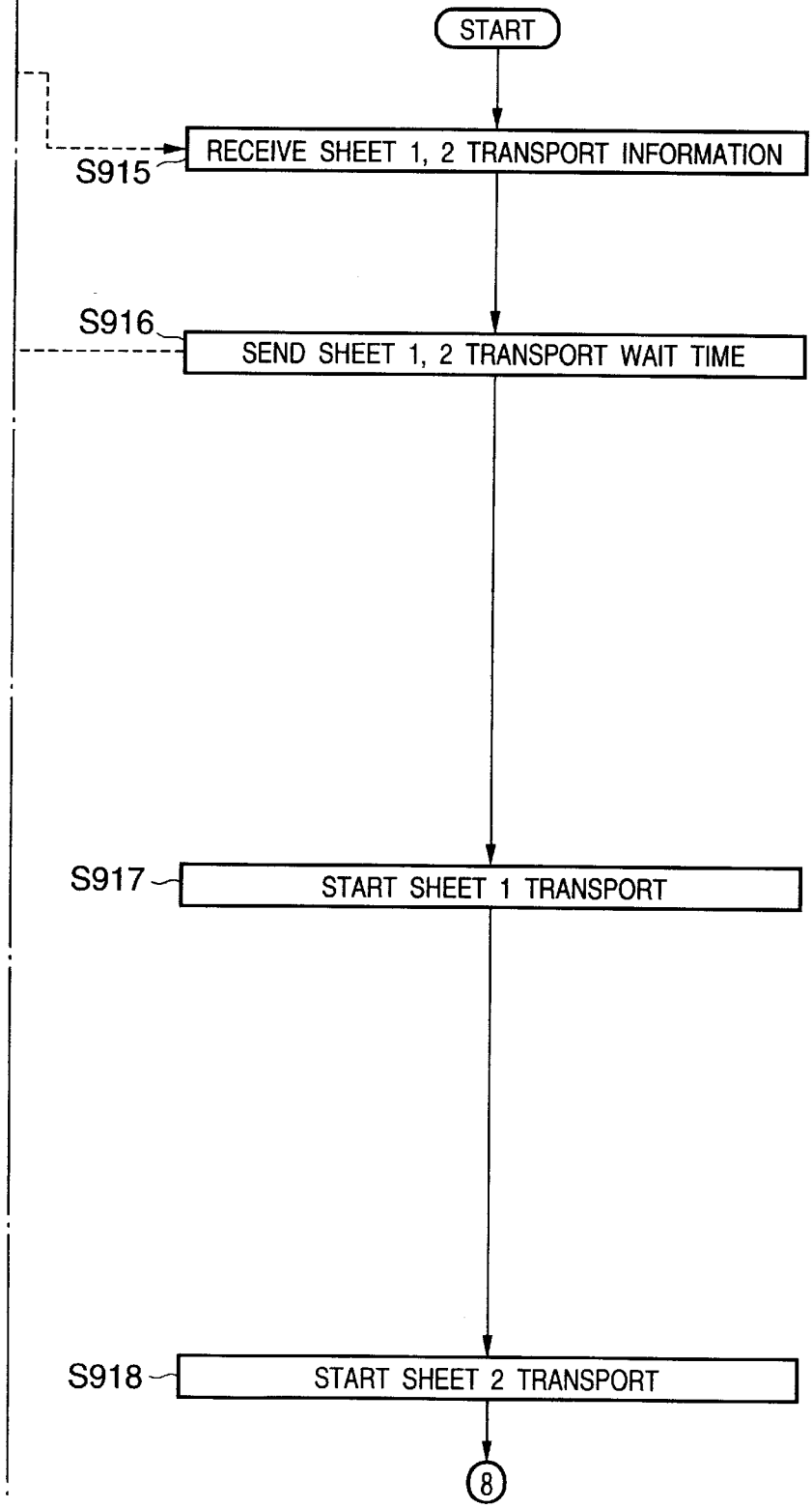

Then, the sheet transport processing operation of the image formation apparatus and option apparatuses according to a second embodiment of the present invention will be explained using the flow charts shown in FIGS. 8A to 8C and FIGS. 9A to 9C. FIGS. 8A to 8C and FIGS. 9A to 9C are the flow charts that show sheet transport processing in the image formation apparatus 100 and the option apparatuses 133 and 134. FIG. 8A and FIG. 9A show the operation of the image formation apparatus 100, FIG. 8B and FIG. 9B show the operation of the option apparatus 133 and FIG. 8C and FIG. 9C show the operation of the option apparatus 134.

In this embodiment, the configuration of the image formation apparatus itself is the same as that of the first embodiment, and therefore explanations thereof will be omitted. Furthermore, in sheet transport processing, which will be explained below, suppose sheet 1 and sheet 2 are ejected from the option apparatus 134 via the option apparatus 133 as in the case of the first embodiment.

First, in step S716, the transport information of sheet 1 and sheet 2 is sent from the image formation apparatus 100 to the option apparatuses 133 and 134. This transport information is received by the option apparatuses 133 and 134 in step S829 and step S915, respectively. Upon reception of the transport information, the option apparatuses 133 and 134 send information on the time required until the own apparatus is allowed to transport sheet 1 and sheet 2 to the corresponding apparatus connected upstream in steps S830 and S916, respectively.

The option apparatus 133 receives the sheet 1, 2 transport wait time data from the option apparatus 134 in step S831 and sends this data together with the wait time of the option apparatus 133 to the image formation apparatus 100 in step S832.

The image formation apparatus 100 receives the sheet 1, 2 transport wait time of the option apparatus 133 in step S717 and receives the wait time of the option apparatus 134 in step S718.

In step S719, it is determined whether sheet 1 can pass through the ejection port 125 or not. Based on the transport wait time for sheet 1 and sheet 2 received in step S717, it is determined that sheet 1 can pass through the ejection port 125 after the timer 200*c* in the image formation apparatus 100 counts the time corresponding to the transport wait time.

Here, the method of calculating the transport wait time will be explained. The time after a certain sheet (called a "preceding sheet") is transported and carried into the option apparatus 133 or the option apparatus 134 until the option apparatus 133 or 134 can accept the next sheet (called the "following sheet") (the time during which the transport or post-processing of the preceding sheet is not affected and the following sheet does not catch up the preceding sheet), that is, the transport wait time can be determined according to the transport distance up to the sheet ejection port in the option apparatus, length of the sheet transported, transport speed and post-processing operation time.

Therefore, it is possible to calculate the transport wait time by storing the transport wait time determined by a combination of these elements in a non-volatile storage medium such as ROM in the option apparatus beforehand or referencing or calculating this stored transport wait time in real time using these values.

This embodiment will be explained assuming that upon reception of the sheet transport information, the option apparatuses 133 and 134 will calculate the sheet transport wait time of their own sheets. When two option apparatuses 133 and 134 are connected to the image formation apparatus 100 as in the case of this embodiment, the ejection wait time at the image formation apparatus 100 can be calculated as follows.

That is, suppose the transport wait time calculated by the option apparatus 133 is T1[S], the transport wait time calculated by the option apparatus 134 is T2[S], then when the option apparatus 134 sends the own transport wait time T2[S] to the image formation apparatus 100 via the option apparatus 133, the option apparatus 133 sends the transport wait time to the image formation apparatus 100 assuming that:

When $T1 \geqq T2$, the transport wait time of the image formation apparatus 100 is T1

When $T1 < T2$, the transport wait time of the image formation apparatus 100 is T2

Of course, it is also possible to configure the system unlike that shown in FIGS. 8A to 8C, so that each option apparatus 133, 134 directly sends T1[S] or T2[S] to the image formation apparatus 100 individually and the image formation apparatus 100 makes the above decision (calculation).

Furthermore, when three or more option apparatuses are connected, it is possible to determine the transport wait time of the image formation apparatus 100 in the like manner based on the option apparatus with the longest transport wait time.

The time required for a communication between the apparatuses should be normally short enough compared to the transport wait time, so even if an upstream apparatus calculates the transport wait time step by step, the number of option apparatuses does not affect the time required to calculate this transport wait time. However, in the case where an option apparatus with extremely low calculation performance is mixed in, it is also possible to configure the system so that when the image formation apparatus 100 recognizes that option apparatus, the transport wait time is directly sent to the image formation apparatus 100.

When the transport wait time has elapsed, the image formation apparatus 100 starts to eject sheet 1 in step S720 and at the same time sends an advance notice of transport to the option apparatus 133.

In step S833, when the option apparatus 133 receives the advance notice of transport that the image formation apparatus 100 sent in step S720, the option apparatus 133 starts to transport sheet 1. In step S834, a sensor, which is not shown in the figure, detects whether sheet 1 has reached a predetermined position near the ejection port or not by detecting the position of the end of the sheet, and when the sensor detects that sheet 1 has reached the predetermined position, the option apparatus 133 starts to eject sheet 1 (step S835). Furthermore, simultaneously with the start of ejection of sheet 1, the option apparatus 133 sends an advance notice of ejection to the option apparatus 134.

Upon reception of the advance notice of ejection that the option apparatus 133 sends in step S835, the option apparatus 134 starts to transport sheet 1 in step S917.

When the ejection of sheet 1 is completed, the option apparatus 133 sends this information to the image formation apparatus 100 in step S836 and the image formation apparatus 100 receives this notice in step S721 and recognizes that sheet 1 has been ejected from the option apparatus 133. Then, in step S722, the image formation apparatus 100 determines whether following sheet 2 can pass through the ejection port 125 or not. Based on the transport wait time of sheet 2 received in step S718, after the timer 200*c* in the image formation apparatus 100 counts, it is determined that following sheet 2 can pass through the ejection port 125. Once it is determined that following sheet 2 can pass through the ejection port 125, the image formation apparatus 100 starts to eject sheet 2 in step S723 and at the same time sends an advance notice of transport to the option apparatus 133.

In step S837, upon reception of the advance notice of transport that the image formation apparatus 100 sent in step S723, the option apparatus 133 starts to transport sheet 2. Then, in step S838, a sensor, which is not shown in the figure, detects whether sheet 2 has reached a predetermined position near the ejection port and when the sensor detects that sheet 2 has reached the predetermined position, the option apparatus 133 starts to eject sheet 2 (step S839). Furthermore, simultaneously with the start of ejection of sheet 2, the option apparatus 133 sends an advance notice of ejection to the option apparatus 134.

On the other hand in step S918, upon reception of the advance notice of ejection that the option apparatus 133 sent in step S839, the option apparatus 134 starts to transport sheet 2. Furthermore, in step S919, when sheet 1 is ejected from the option apparatus 134, the option apparatus 134 notifies this to the option apparatus 133, the upstream apparatus.

The option apparatus 133 receives the notice of the ejection of sheet 1 at the option apparatus 134 in step S840 and notifies the image formation apparatus 100 of the ejection of sheet 1 from the option apparatus 134 in step S841. The image formation apparatus 100 recognizes in step S724 that sheet 1 has been ejected from the option apparatus 134.

Then, in step S842, the option apparatus 133 notifies the image formation apparatus 100 that sheet 2 has been ejected from the option apparatus 133 and the image formation apparatus 100 recognizes this in step S725.

When sheet 2 has been ejected last, the option apparatus 134 notifies this to the option apparatus 133 in step S920. This notification is received by the option apparatus 133 in step S843 and then transmitted to the image formation apparatus 100 in step S844. Then, the image formation apparatus 100 recognizes in step S726 that the ejection of sheet 2 from the option apparatus 134 has been completed.

As described in this embodiment, it is possible to reduce the processing load by the image formation apparatus receiving the information of the time required until it is possible to sequentially eject sheets from a plurality of option apparatuses connected downstream and by the option apparatuses connected downstream from the image formation apparatus performing sheet transport control and monitoring processing.

Similarly, it is possible to reduce the processing load also in the configuration in which in addition to the paper ejection apparatuses 133, 134, a plurality of paper ejection option apparatuses are connected downstream.

Third Embodiment

Next, the sheet transport operations of the image formation apparatus and option apparatuses according to a third embodiment of the present invention will be explained. In this embodiment, with regard to the processing in step S104 and step S106 explained using the flow charts in FIG. 3A to 3C, the image formation apparatus 100 acquires the apparatus information from the option apparatuses 101 and 102 as to whether it is possible to perform sheet transport control and monitoring processing of other option apparatuses connected upstream as communication data, and in step S105 and step S107, the image formation apparatus 100 determines the processing capacities of the option apparatuses 101 and 102 and directly performs sheet transport control and monitoring processing of the option apparatus 102 upstream from the option apparatus 101 without the intermediary of the option apparatus 101, which cannot control or monitor the option apparatus 102.

Furthermore, with regard to the option apparatuses 133 and 134 connected downstream from the image formation apparatus 100, though not shown in the figure, the image formation apparatus 100 also directly perform sheet transport control and monitoring processing.

Figure 10B:
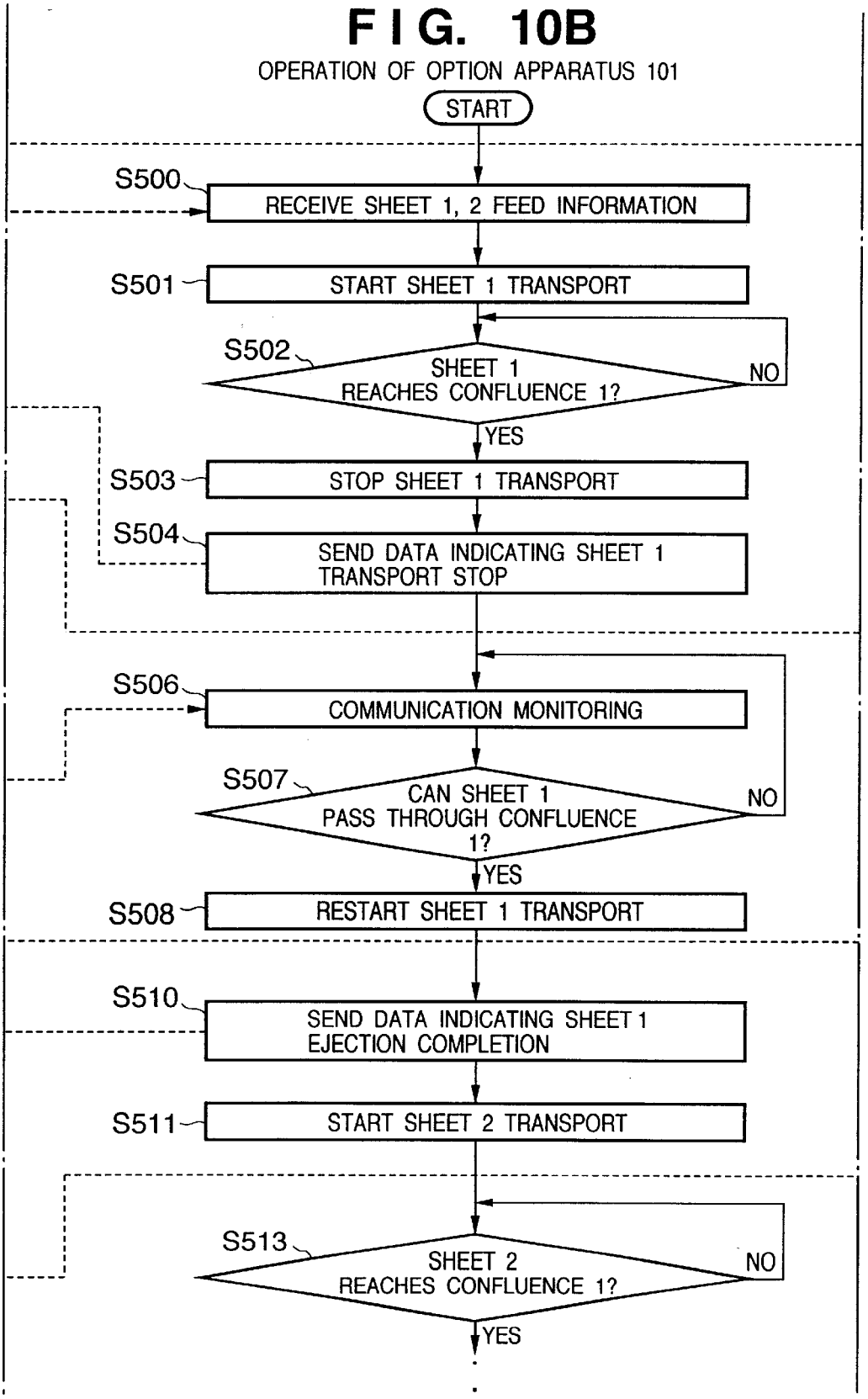
Figure 10C:
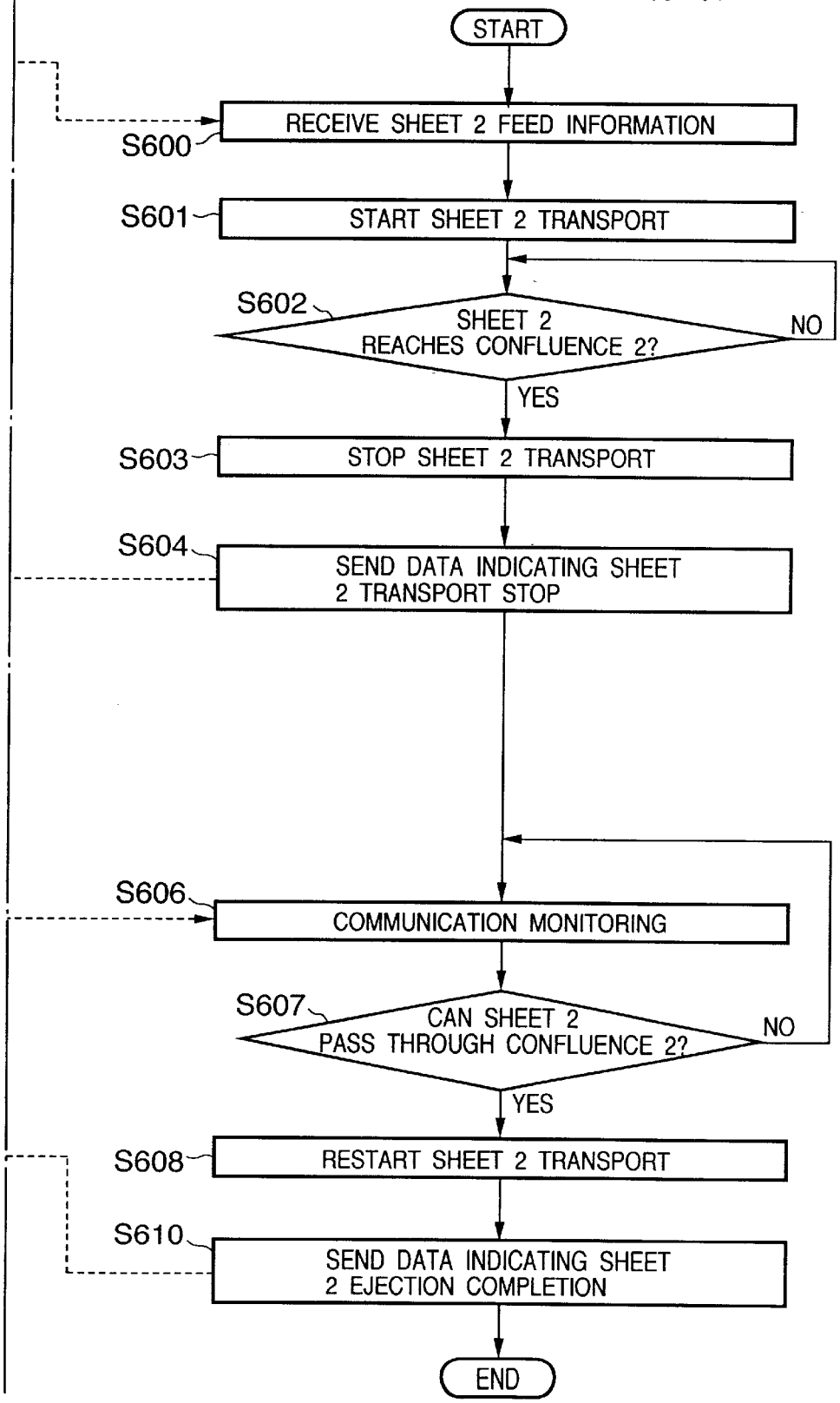

The processing in that case will be explained using the flow charts shown in FIGS. 10A to 10C. FIGS. 10A to 10C are modifications of the sheet transport (feeding) processing explained using the flow charts shown in FIGS. 4A to 4D in the first embodiment and shows the processing after the image formation apparatus 100 determines that the option apparatus 101 cannot perform sheet transport control and monitoring processing of the upstream option apparatus 102. In FIGS. 10A to 10C, the same processes as those in FIGS. 4A to 4D will be assigned the same step numbers and detailed explanations thereof will be omitted.

In step S409, the image formation apparatus 100 performs processing equivalent to step S505 in FIG. 4B and directly controls the sheet transport state of the option apparatus 102. Likewise, in step S411, the image formation apparatus 100 performs the processing in step S509 in FIG. 4B and instructs the option apparatus 102 to restart to transport sheet 2 while monitoring sheet 1.

Furthermore, in step S413, the image formation apparatus 100 performs processing equivalent to that in step S512 in FIG. 4B, that is, the image formation apparatus 100 recognizes that sheet 2 has been ejected from the option apparatus 102 and recognizes that the option apparatus 101 will continue to transport sheet 2.

Hereafter, the image formation apparatus 100 performs transport control and monitoring processing of sheet 2 in the option apparatus 101.

This embodiment only describes the processing of the sheet supply option apparatuses, but with regard to the sheet ejection option apparatuses connected downstream from the image formation apparatus 100, the image formation apparatus 100 can also perform similar processing by directly controlling without the intermediary of an option apparatus with low processing performance.

As described above, according to this embodiment, the image formation apparatus acquires the processing performance of each option apparatus connected by the communication means after power is turned on and when it is determined that an option apparatus connected upstream or downstream cannot perform control or monitoring of other option apparatuses, the image formation apparatus can directly control the option apparatus connected one step upstream (or downstream) from the option apparatus.

Other Embodiment

The first to third embodiments above describe the cases where two option apparatuses are installed upstream from the image formation apparatus 100, two option apparatuses are installed downstream and two sheets are transported, but the configuration is not limited to this and the number of option apparatuses connected, the number of sheets transported and timings of image formation processing or ejection completion processing, etc. can all be set arbitrarily.

Moreover, the method of communications between the image formation apparatus and the option apparatuses is not limited to a particular method, but any protocol can be used.

Furthermore, the above embodiments only describe option apparatuses involved in sheet transport, but the effects of the present invention can be implemented with any option apparatuses serially connected from the image formation apparatus even if they are not sheet transport option apparatuses.

Furthermore, FIGS. 3A to 3C illustrate the case where a timer is started when power is turned on and power to the downstream option apparatuses is turned on when the timer times out, but it is also possible to configure the system so that power to the downstream option apparatuses is turned on upon completion of predetermined processing such as initialization processing carried out after powering-on is completed, for example.

The present invention can also be applied to a system configured by a plurality of devices (for example, host computer, interface device, reader, printer, etc.) or to a standalone apparatus (for example, copier, facsimile apparatus, etc.).

Furthermore, it goes without saying that the object of the present invention can be attained by supplying a storage medium (or recording medium) that records program codes of software implementing the functions of the aforementioned embodiments to a system or apparatus and allowing a computer (or CPU or MPU) of the system or apparatus to read and execute the program codes stored in the storage medium. In this case, the program codes read from the storage medium themselves implement the functions of the aforementioned embodiments and the storage medium that stores the program codes make up the present invention. Furthermore, it goes without saying that the present invention includes not only the case where the functions of the aforementioned embodiments are implemented by executing the program codes read by the computer but also the case where the operating system (OS), etc. operating on the computer performs part or the whole of actual processing and the functions of the aforementioned embodiments are implemented through this processing.

Furthermore, it goes without saying that the present invention also includes the case where after the program codes read from the storage medium are written in memory provided on a function expansion card inserted into the computer or a function expansion unit connected to the computer, the function expansion card or the CPU, etc. provided on the function expansion unit performs part or the whole of actual processing and the functions of the aforementioned embodiments are implemented through this processing.

When the present invention is applied to the above storage medium, the program codes corresponding to the flow charts explained above (shown in at least one of FIG. 3A to FIG. 10) are stored in the storage medium.

As explained above, according to the image formation apparatus and option apparatuses of the present invention, it is possible to distribute control of the entire apparatus by allowing each apparatus to perform monitoring or control of the operation of an option apparatus immediately upstream and/or immediately downstream, thus reducing the processing load of the image processing apparatus or option controller, preventing the processing load of the image processing apparatus from drastically increasing even if the number of option apparatuses connected changes, and thereby having the effect of making it possible to configure the image processing apparatus without using expensive circuit parts with high-speed processing capability.

The present invention has been described above based on the preferred embodiments. However, these embodiments are intended to contribute to a better understanding of the present invention and it goes without saying that the present invention is not limited to the scope disclosed in the above described embodiments. The present invention is intended to include any variations made possible by those skilled in the art without departing from the spirit of the present invention specified in the following claims.

What is claimed is:

1. An option apparatus of an image formation apparatus connectable to the image formation apparatus directly or via an intermediate option apparatus, adapted for connecting to a remote option apparatus while being connected to said image formation apparatus, comprising:

directly connected communication means for communicating with at least one of the image formation apparatus and said intermediate option apparatus; and option apparatus controlling means for controlling operation of said option apparatus; and monitoring means for monitoring a state of said at least one of the image formation apparatus and said intermediate option apparatus;

wherein said option apparatus controlling means controls the operation of said option apparatus based on the monitored state of said at least one of the image formation apparatus and said intermediate option apparatus.

2. The option apparatus of the image formation apparatus according to claim 1, further comprising power supply controlling means for performing power supply control on said remote option apparatus, wherein said power supply controlling means turns on the power to said remote option apparatus a predetermined time after power to said option apparatus is turned on or after predetermined processing is completed.

3. The option apparatus of the image formation apparatus according to claim 1, wherein said option apparatus determines whether it is possible to control and/or monitor the operation of said remote option apparatus and sends said determination result to said image formation apparatus or said intermediate option apparatus.

4. The option apparatus of the image formation apparatus according to claim 1, wherein said option apparatus is an option apparatus that transports the recording medium to said image formation apparatus and/or ejects a recording medium from said image formation apparatus.

5. An image formation apparatus capable of connecting 1 stage and/or multi-stages of the option apparatus of the image formation apparatus according to claim 1, comprising image formation controlling means for controlling image formation processing using said option apparatus, wherein said image formation controlling means monitors and/or controls the operation of a directly connected option apparatus and monitors the state of the option apparatuses connected through said directly connected option apparatus onward through a communication with said directly connected option apparatus.

6. A recording medium that stores a program executable by a computer apparatus, wherein the apparatus that executes said program is allowed to function as the image formation apparatus according to claim 5.

7. A recording medium that stores a program executable by a computer apparatus, wherein the apparatus that executes said program is allowed to function as an option apparatus for the image formation apparatus according to claim 1.

8. An image formation system comprising an image formation apparatus and an option apparatus connectable to the image formation apparatus directly or via an intermediate option apparatus, adapted for connecting to a remote option apparatus while being connected to said image formation apparatus, said option apparatus comprising:

directly connected communication means for communicating with at least one of said image formation apparatus and said intermediate option apparatus;

monitoring means for monitoring a state of at least one of the image formation apparatus and said intermediate option apparatus; and option apparatus controlling means for controlling operation of said option apparatus based on the monitored state of said at least one of the image forming apparatus and said intermediate option apparatus.

9. The image formation system according to claim 8, said image formation apparatus further comprising main unit power supply controlling means for performing power supply control over said directly connected option apparatus, said option apparatus further comprising option apparatus power supply controlling means for performing power supply control over said remote option apparatus directly connected away from said image formation apparatus, wherein said main unit power supply controlling means turns on the power to said directly connected option apparatus, and said option apparatus power supply controlling means turns remote option apparatus a predetermined time after power is turned on or after predetermined processing is completed.

10. The image formation system according to claim 8, wherein said option apparatus determines whether it is possible to control and/or monitor the operation of said remote option apparatus and sends said determination result to said image formation apparatus or the intermediate option apparatus.

11. The image formation system according to claim 10, wherein when said image formation controlling means collects said determination results of all option apparatuses in the system and when said determination results show that there exists an option apparatus whose control and/or monitoring is impossible, said image formation controlling means directly controls the determined option apparatus separate from other option apparatus connected to said option apparatus.

12. A recording medium that stores a program executable by a computer apparatus, wherein the apparatus that executes said program is allowed to function as the image formation apparatus in the image formation system according to claim 8.

13. A recording medium that stores a program executable by a computer apparatus, wherein the apparatus that executes said program is allowed to function as an option apparatus in the image formation system according to claim 8.

14. An image forming system comprising:

a plurality of recording medium handling apparatus including an image formation apparatus, at least one recording medium supplying apparatus for supplying a recording medium and at least one recording medium ejecting apparatus for ejecting a recording medium; and communicating means for connecting said plurality of recording medium handling apparatus, wherein each recording medium handling apparatus, to which another recording medium handling apparatus is directly connected on a side corresponding to the upper stream of the transportation path of the recording medium (upper recording medium handling apparatus), comprises:

sending means for sending a permission signal to said communicating means indicating a recording medium is acceptable;

first conveying controlling means for controlling a conveyance of the recording medium transported from said upper recording medium handling apparatus, and wherein each recording medium handling apparatus, to which another recording medium handling means is directly connected on a side corresponding to the lower stream of the transportation path of the recording medium (lower recording medium handling apparatus), comprises:

monitoring means for monitoring said permission signal sent from said lower recording medium handling apparatus via said communicating means without intervention of another recording medium handling apparatus; and second conveying controlling means for controlling, based on said permission signal, a conveyance of the recording medium to said lower recording medium handling apparatus.

* * * * *

UNITED STATES PATENT AND TRADEMARK OFFICE

CERTIFICATE OF CORRECTION

PATENT NO. : 6,516,167 B2
DATED : February 4, 2003
INVENTOR(S) : Mitsuhide Takamura It is certified that error appears in the above-identified patent and that said Letters Patent is hereby corrected as shown below:

Column 7,
Line 11, “start ed” should read -- started --.

Column 13,
Line 13, “band,” should read -- hand, --.

Column 21,
Line 9, “turns” should read -- turns off power to said --.

Signed and Sealed this

Sixteenth Day of September, 2003

JAMES E. ROGAN
*Director of the United States Patent and Trademark Office*